US011454183B1

(12) United States Patent
Cung et al.

(10) Patent No.: US 11,454,183 B1
(45) Date of Patent: Sep. 27, 2022

(54) METHOD OF GENERATING RATE-OF-INJECTION (ROI) PROFILES FOR A FUEL INJECTOR AND SYSTEM IMPLEMENTING SAME

(71) Applicant: SOUTHWEST RESEARCH INSTITUTE, San Antonio, TX (US)

(72) Inventors: Khanh D. Cung, San Antonio, TX (US); Zachary L. Williams, New Braunfels, TX (US); Ahmed A. Moiz, San Antonio, TX (US); Daniel C. Bitsis, Jr., San Antonio, TX (US)

(73) Assignee: SOUTHWEST RESEARCH INSTITUTE, San Antonio, TX (US)

( * ) Notice: Subject to any disclaimer, the term of this patent is extended or adjusted under 35 U.S.C. 154(b) by 0 days.

(21) Appl. No.: 17/643,318

(22) Filed: Dec. 8, 2021

(51) Int. Cl.
*F02D 41/14* (2006.01)
*F02D 41/24* (2006.01)

(52) U.S. Cl.
CPC ..... *F02D 41/1405* (2013.01); *F02D 41/1406* (2013.01); *F02D 41/248* (2013.01); *F02D 41/2467* (2013.01); *F02D 41/2477* (2013.01); *F02D 2041/1412* (2013.01); *F02D 2041/1432* (2013.01); *F02D 2041/1433* (2013.01); *F02D 2200/0602* (2013.01); *F02D 2250/04* (2013.01); *F02D 2250/31* (2013.01)

(58) Field of Classification Search
CPC ..... F02D 41/1405; F02D 41/1406; F02D 41/2467; F02D 41/2477; F02D 41/248; F02D 2041/1412; F02D 2041/1433; F02D 2200/0602; F02D 2250/04
USPC ..... 701/103, 104, 105
See application file for complete search history.

(56) References Cited

U.S. PATENT DOCUMENTS

| | | | | |
|---|---|---|---|---|
| 6,405,122 | B1 * | 6/2002 | Yamaguchi | F02D 41/1405 706/31 |
| 10,914,262 | B1 | 2/2021 | Laskowsky et al. | |
| 10,947,919 | B1 * | 3/2021 | Charbonnel | F02D 41/0085 |
| 11,047,325 | B2 * | 6/2021 | Maeda | G06N 3/0481 |
| 2008/0201054 | A1 * | 8/2008 | Grichnik | F02D 41/1401 703/2 |

(Continued)

OTHER PUBLICATIONS

Abdullah, et al., "Optical Diagnostics of Inversed-Delta Rate Shaping Diesel Spray Flame towards Reduction of Late Combustion", SAE Technical Paper, 2018-01-1793, pp. 1-13.

(Continued)

*Primary Examiner* — Erick R Solis
(74) *Attorney, Agent, or Firm* — Grossman, Tucker, Perreault & Pfleger, PLLC

(57) ABSTRACT

A method of generating an ROI profile for a fuel injector using machine learning and a constrained/limited training data set is disclosed. The method includes receiving a first plurality of measurement sets for a fuel injector when operating at a first target set point. Preferably, at least two measurement sets of the first plurality of measurement sets are selected to generate a first averaged ROI profile for the first target condition. The at least two selected measurement sets are then used to train a machine learning model that can output a predicted ROI profile for a fuel injector based on a desired pressure value and/or desired mass flow rate value. Training of the machine learning model preferably includes a predetermined number of iterations that induces overfitting within the model/neural network.

29 Claims, 28 Drawing Sheets

(56) References Cited

U.S. PATENT DOCUMENTS

| | | | | |
|---|---|---|---|---|
| 2009/0112334 | A1* | 4/2009 | Grichnik | F02D 41/26 700/48 |
| 2011/0264353 | A1* | 10/2011 | Atkinson | F02D 41/1402 706/14 |
| 2012/0203447 | A1* | 8/2012 | Kammerstetter | F02D 41/22 123/480 |
| 2020/0108815 | A1* | 4/2020 | Nakamura | F02D 41/1405 |

OTHER PUBLICATIONS

Bosch, "The Fuel Rate Indicator: A New Measuring Instrument for Display of the Characteristics of Individual Injection", pp. 641-662.
Cung, et al., "Characteristics of Formaldehyde (CH2O) Formation in Dimethyl Ether (DME) Spray Combustion Using PLIF Imaging", SAE International Journal of Fuels and Lubricants, vol. 9, Issue 1, 2016, pp. 138-148.
Cung, et al., "Effect of Micro-Hole Nozzle on Diesel Spray and Combustion", SAE International, 2018, 13 pages.
Cung, et al., "Ignition and Formaldehyde Formation in Dimethyl Ether (DME) Reacting Spray Under Various EGR Levels", Proceedings of the Combustion Institute, vol. 36, Elsevier, 2017, pp. 3605-3612.
Cung, et al., "Spray-Combustion Interaction Mechanism of Multiple-Injection Under Diesel Engine Conditions", Proceedings of the Combustion Institute, vol. 35, Elsevier Inc , 2015, pp. 3061-3068.
Desantes, "Measurements of Spray Momentum for the Study of Cavitation in Diesel Injection Nozzles", SAE International, Detroit, MI, 2003, (12 pages).
Hengl, et al., "Random Forest as a Generic Framework for Predictive Modeling of Spatial and Spatio-Temporal Variables", Peer J, 2018, pp. 1-49.
Koci, et al., "Understanding Hydrocarbon Emissions in Heavy Duty Diesel Engines Combining Experimental and Computational Methods", SAE International Journal of Engines, vol. 10, Issue 3, 2017, 17 pages.
Kodavasal, et al., "Machine Learning Analysis of Factors Impacting Cycle-to-Cycle Variation in a Gasoline Spark-Ignited Engine", Proceedings of the ASME 2017 Internal Combustion Engine Division Fall Technical Conference ICEF2017, Oct. 15-18, 2017, Seattle, Washington, pp. 1-10.
Le Cornec, et al., "Modelling of Instantaneous Emissions from Diesel Vehicles with a Special Focus on NOx: Insights from Machine Learning Techniques", Science Direct, Elsevier, 2020, pp. 1-28.
Lee, et al., "Droplets and Sprays Applications for Combustion and Propulsion, Chapter 11, Turbulant Spray Combustion", Energy, Environment, and Sustainability, Springer Nature, Singapore, 2018, pp. 277-312.
Leach, et al., "The Scope for Improving the Efficiency and Environmental Impact of Internal Combustion Engines", Transportation Engineering, vol. 1, Elsevier, 2020, 17 pages.
Moiz, et al., "A Machine Learning-Genetic Algorithm (ML-GA) Approach for Rapid Optimization Using High-Performance Computing", SAE International Journal of Commercial Vehicles, vol. 11, Best Papers Special Issue, pp. 291-305.
Moiz, et al., "Investigation of Gasoline Compression Ignition in a Heavy-Duty Diesel Engine Using Computational Fluid Dynamics", SAE International 2021, 10 pages.
Moiz, et al., "Ignition, Lift-Off, and Soot Formation Studies in N-Dodecane Split Injection Spray-Flames", International Journal of Engine Research, vol. 18, Issue 10, Sage Publications, 2017, pp. 1077-1087.
Nishida, et al., "Effects of Micro-Hole Nozzle and Ultra-High Injection Pressure on Air Entrainment, Liquid Penetration, Flame Lift-Off and Soot Formation of Diesel Spray Flame", Journal of Engine Research, vol. 18(1-2), Sage Publications, 2017, pp. 51-65.
Park, et al., "Applicability of Dimethyl Ether (DME) in a Compression Ignition Engine as an Alternative Fuel", Energy Conversion and Management, vol. 86, Elsevier, 2014, pp. 848-863.
Payri, et al., "On the Rate of Injection Modeling Applied to Direct Injection Compression Ignition Engines", International Journal of Engine Research, 2016, pp. 1-39.
Pei, et al., "CFD-Guided Combustion System Optimization of a Gasoline Range Fuel in a Heavy-Duty Compression Ignition Engine Using Automatic Piston Geometry Generation and a Supercomputer", SAE International, 2019, 14 pages.
Pickett, et al., "Orifice Diameter Effects on Diesel Fuel Jet Flame Structure", Journal of Engineering for Gas Turbines and Power, vol. 127, 2005, pp. 187-196.
Shah, et al., "A Comprehensive CFD-FEA Conjugate Heat Transfer Analysis for Diesel and Gasoline Engines", SAE International, 2019, 9 pages.
Weber, et al., "Next Improvement Potentials for Heavy-Duty Diesel Engine—Tailor the Fuel Injection System to the Combustion Needs", SAE Journal of Engines, vol. 10, Issue 3, 2017, pp. 1119-1127.
Willems, et al., "Ramped Versus Square Injection Rate Experiments in a Heavy-Duty Diesel Engine", SAE Technical Paper, 2020, 15 pages.

* cited by examiner

300

TABLE 1

| | |
|---|---|
| Hydraulic Fuel Pump | Model 5L-ST-900-HTO<br>Shop Air Driven Pump<br>Rate 6000 bar |
| Rail pressure line rate | 100,000 psi |
| Injector Type | Solenoid |
| Manufacturer & Model | Delphi F2E<br>Non-pumping |
| Common Rail | Production rail (Volvo D13 engine) |
| Nozzle Configuration | 6-hole<br>Diameter = 248 μm<br>Spray Inclusion Angle = 150° |
| DAQ | NIcDAQ-9155 with slot of NI 9223<br>Sampling rate = 100 kHz |
| Injector Driver | Software: National Instrument<br>Injector Driver: Drivven |
| Pressure sensor | Kistler model 6045A |
| Charge Amp | 5010 |
| Mass Scale | LE160018<br>Readability ±0.1g |

FIG. 8A

TABLE 2

| Parameter | Unit | Value |
|---|---|---|
| Fuel | - | Ultra-low Sulfer Diesel (ULSD) |
| Fuel Temperature | °C | 22 |
| Fuel Density | $kg/m^3$ | 820 |
| Rail Pressure | bar | 600, 1200, 1600, 2000, 2400 |
| Injector Command Dur | ms | 0.5, 0.75, 1.0, 1.5, 2.0, 3.0 |
| Fuel Return Back Pressure | bar | 6.0 |
| Chamber Pressure | bar | 4.0 |
| Number of Injection per Test | - | 100 |

FIG. 8B

TABLE 3

| Region | Function Name | Function | Domain |
|---|---|---|---|
| Ramp-up | Linear | $y(x) = mx + b$ | $0 = t > t$ |
| Top Flow | Dampened Cosine Wave + Exponential Decay | $y(x) = Xe^{-\alpha x} \cos \omega x + X_2 e^{-\alpha_2 x} + c$ | $t_{fb} = t =$ |
| Ramp-Down | Linear | $y(x) = mx + b$ | $t_{tfe} > t = t$ |

FIG. 14

METHOD OF GENERATING RATE-OF-INJECTION (ROI) PROFILES FOR A FUEL INJECTOR AND SYSTEM IMPLEMENTING SAME

FIELD

The present disclosure is generally directed to fuel injection systems, and in particular, to a method of generating rate-of-injection (ROI) profiles for a fuel injector using a machine learning model and a constrained/limited data set for training thereof.

BACKGROUND

In compression ignition (CI) engines, the fuel injector determines the rate of fuel entering the overall combustion system via in-cylinder fuel delivery. The performance of an injector is generally determined via the generation of a ROI profile. The ROI profile describes an instantaneous fuel flow as it leaves the injector nozzle. Both the fuel injector's dynamic mechanism (from needle opening to needle closing) and the fuel injector's geometry impact the ROI profile. Specialized measurement arrangements, such as Bosch-tube assemblies, are often utilized to capture an ROI profile for a fuel injector. A robust ROI profile can include hundreds or thousands of measurement cycles to account for a range of operating conditions, including target fuel rail pressure and injection duration.

BRIEF DESCRIPTION OF THE DRAWINGS

FIG. 8A is a table that outlines the configuration of a fuel and data acquisition (DAQ) systems used to capture/collect pressure measurement during an experimental ROI generation process disclosed herein.

FIG. 8B is a table that outlines various test conditions utilized during experimental ROI generation process disclosed herein.

FIG. 14 is a table that provides example mathematical functions for categorizing each region of an ROI profile, as shown in FIG. 13.

Figure 1A:
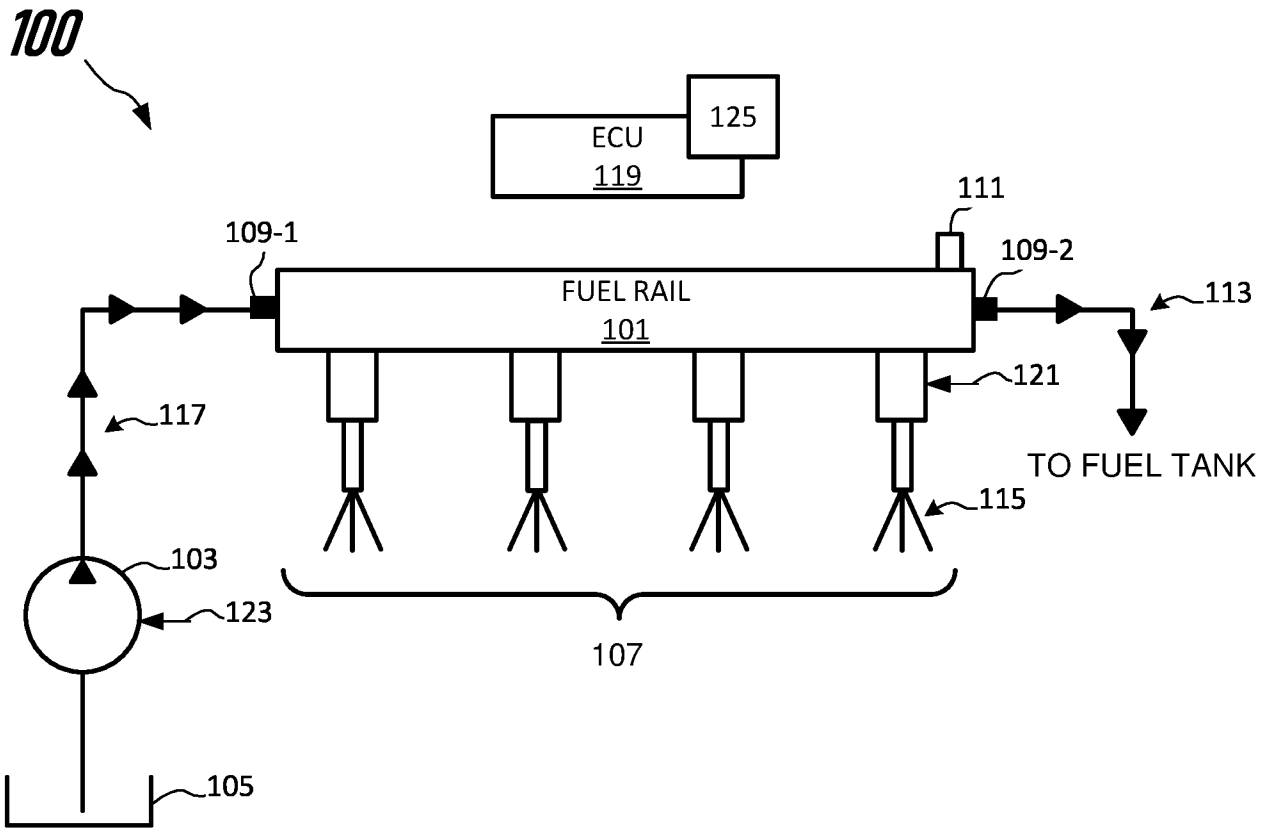
FIG. 1A shows an example fuel delivery system in accordance with aspects of the present disclosure.

These and other features of the present disclosure will be understood better by reading the following detailed description, taken together with the figures herein described. The accompanying drawings are not intended to be drawn to scale. In the drawings, each identical or nearly identical component that is illustrated in various figures is represented by a like numeral. For purposes of clarity, not every component may be labeled in every drawing.

DETAILED DESCRIPTION

Existing approaches to generating an ROI profile for a fuel injector includes the use of a specialized test rig/ assembly, such as a Bosch-tube and Momentum Flux. To ensure the accuracy of a generated ROI profile across a range of operating conditions, hundreds or thousands of test runs may be performed. Each test run can target a particular combination of operating conditions, e.g., a particular target fuel rail pressure and injection duration (also known as a pulse duration). Even minor changes in operating conditions can significantly vary the generated ROI profile. There exists a need to provide accurate ROI profiles for a fuel injector without the necessity of hundreds/thousands of measurement iterations using a complex test rig/assembly, and thus by extension, avoiding the expense of tens or hundreds of hours of testing to complete the measurement iterations.

Thus, in accordance with an aspect of the present disclosure, a method of generating an ROI profile for a fuel injector using a constrained/limited data set is disclosed. The method includes receiving a first plurality of measurement sets for a fuel injector when operating at a first target set point, which may also be referred to herein as a target condition or simply a condition. The measurement sets can be captured/collected from a measurement rig such as a Bosch-tube. Preferably, at least two measurement sets of the first plurality of measurement sets are selected to generate a first averaged ROI profile for the first target condition. The at least two selected measurement sets are then used to train a machine learning model that can output a predicted ROI profile for a fuel injector based on a desired pressure value and/or desired mass flow rate value. Training of the machine learning model preferably includes a predetermined number of iterations that induces overfitting within the model/neural network. An iteration in the context of training a neural network means one forward and backward pass of input/training data through the neural network to update the connections/weightings between each neuron to reduce error/loss.

As generally referred to herein, overfitting in the context of a machine learning model means executing a predetermined number of training iterations for a model until the distance from each predicted value and the actual/measured value is below a target threshold value. The overall output error rate for a model is referred to as a convergence error rate or a convergence error during training. The distance between predicted input and actual/measured is referred to as cost/loss, and the mean of the squared losses is referred to as mean squared error. Mean squared error of a model may be used as the criteria for convergence. One example target threshold value for the mean squared error rate is in a range of 0.001 to 0.0001, and more preferably, the target threshold value is less than or equal to 0.0001. The number of training iterations to achieve such overfitting can vary depending on the training data set and the composition of the machine learning model. In one specific non-limiting example, the number of training iterations that induced the desired overfitting in a multilayer perceptron (MLP) neural network (or MLP neural net) configured consistent with the present disclosure and having a hidden layer size of 300 neurons was 10^9 iterations. However, the selected number of iterations can vary and be in a range of 10^6 to 10^9, for example, depending on the composition of the neural net and the associated convergence threshold.

This disclosure has identified that a machine learning model configured consistent with the present disclosure advantageously achieves an accuracy for generated/predicted ROIs that is substantially equal to measured ROIs, e.g., with an error rate of 0.17% or less as compared to measured/empirical ROIs. Moreover, a machine learning model consistent with the present disclosure can achieve this relatively low error rate using a training data set that is constrained/minimized. As discussed in the experimental results provided below, an example training data set comprising only one hundred injection cycles for a fuel injector was sufficient to predict/generate an ROI within 5% of actual.

The present disclosure has identified that various aspects of fuel injector performance is based on factors which are independent of the fuel tube dimensions and operating conditions such as pressure, and instead are dependent on the fuel injector geometry itself and fuel characteristics. This results in the ROI profile for a fuel injector following a similar path/shape over the beginning, middle, and end of an injection cycle (referred to herein as the ramp-up, top-flow, and ramp-down, respectively) regardless of the selected rail pressure and selected injection duration.

Accordingly, a machine learning model consistent with the present disclosure advantageously utilize a limited/constrained data set for training of the model that can produce accurate ROI predictions through overfitting. Existing approaches to training of machine learning models seek to avoid such overfitting as this can reduce a model's ability to generalize (e.g., to infer/predict an output from a novel/new input value outside of the training set), and can cause secondary patterns within data to be "learned" including those patterns caused by noise. A machine learning model consistent with the present disclosure minimizes or otherwise reduces such drawbacks by ensuring that the measurement sets selected for training have low uncertainty/low standard deviation (and are de-noised as disclosed herein), and by exploiting the recognition that fuel injector performance over each injection cycle is effectively independent of rail pressure and injection duration thus providing accurate and reliable interpolation by the machine learning model. One preferred machine learning model is a MLP neural network (or MLP neural net) which is particularly well suited to interpolation when induced to overfit during training. This appears to be a natural extension of a MLP neural net's ability to learn and predict output values from non-linear data sets.

The output, e.g., the generated/predicted ROI profile, of a machine learning model consistent with the present disclosure can be utilized in various scenarios. A machine learning model consistent with the present disclosure may also be referred to as a ROI machine learning model or simply a ROI model. This generated ROI profile may also be referred to herein as a machine learning (ML) ROI profile.

In one example, a three-dimensional Computational Fluid Dynamics (CFD) simulation can utilize a generated ROI profile consistent with the present disclosure as an input to model the behavior of a fuel delivery system. This can advantageously avoid using an oversimplified ROI profile, which is often used in existing simulations when empirical measurements of a fuel injector are impractical/unavailable and can result in inaccurately simulating the actual physics of fuel delivery in a given engine design. Further, the ML ROI can provide an accurate, high-resolution fuel map for any desired/selected operating set point/condition (e.g., rail pressure, total fuel, and timing for multiple concurrent injection events).

A machine learning model consistent with the present disclosure may also be used as a sub-system in an artificial intelligence (AI)-driven engine control system that can govern engine performance, e.g., for fuel optimization. Such AI-driven engine control systems can be implemented within engine controllers of a vehicle, for instance, in order to increase operational performance, e.g., improved fuel efficiency.

Aspects of the present disclosure can be used with, or as an alternative to, existing map-based calibration of an engine to provide fine grain control, and virtually infinite resolution within the bounds of the fuel mapping. Thus, aspects of the present disclosure enable engine calibration using accurate ROI predictive models to command and optimize a given fuel injection strategy.

Thus, aspects of the present disclosure can be implemented within an engine controller and can optionally communicate with external server systems, e.g., via the Internet, to report fuel injector performance. For fleets of vehicles, for example, the reported fuel injector performance may then be analyzed, along with the reported data from other fleet vehicles, and used to determine an adjustment to a target operational characteristic for one or more fleet vehicles. Likewise, the reported fuel injector performance may be utilized to generate training data set updates for each ROI machine learning model. Thus, an engine controller consistent with the present disclosure can receive an update from an external server system to adjust the target operational characteristic of the engine and/or to update the associated ROI machine learning model. Some such example target operational characteristics includes at least one of an engine efficiency target (e.g., miles per gallon), a target aftertreatment temperature for use by an exhaust gas thermal management system, and/or a soot emissions target.

Turning to the Figures, FIG. 1A shows an example of a fuel delivery system 100. The fuel delivery system 100 can be implemented within an engine, such as a diesel engine. The fuel delivery system includes a fuel rail 101 and an engine control unit (ECU) 119. The ECU 119 can include a memory 125.

The fuel rail 101 preferably fluidly couples to a plurality of fuel injectors 107. The fuel injectors 107 are preferably implemented as solenoid-type fuel injectors that are configured to receive an electrical current, e.g., electrical current 121 from the ECU 119, to actuate and output fuel 115 for a predetermined duration. The electrical current 121 may also be referred to herein as a driving current. An input 109-1 of the fuel rail 101 can fluidly couple to a fuel tank 105 by way of a feed line 117. A fuel pump 103 is preferably disposed along the feed line 117 and is configured to displace fuel from the fuel tank 105 towards the fuel rail 101. The fuel pump 103 is preferably configured to receive an electrical signal 123, e.g., from the ECU 119, to maintain a nominal/target pressure within the fuel rail 101.

The fuel rail 101 can include a pressure regulator 111 to maintain the nominal/target pressure. An output 109-2 of the fuel rail 101 is preferably coupled to a return line 113. The return line 113 can be fluidly coupled to the fuel tank 105.

Figure 1B:
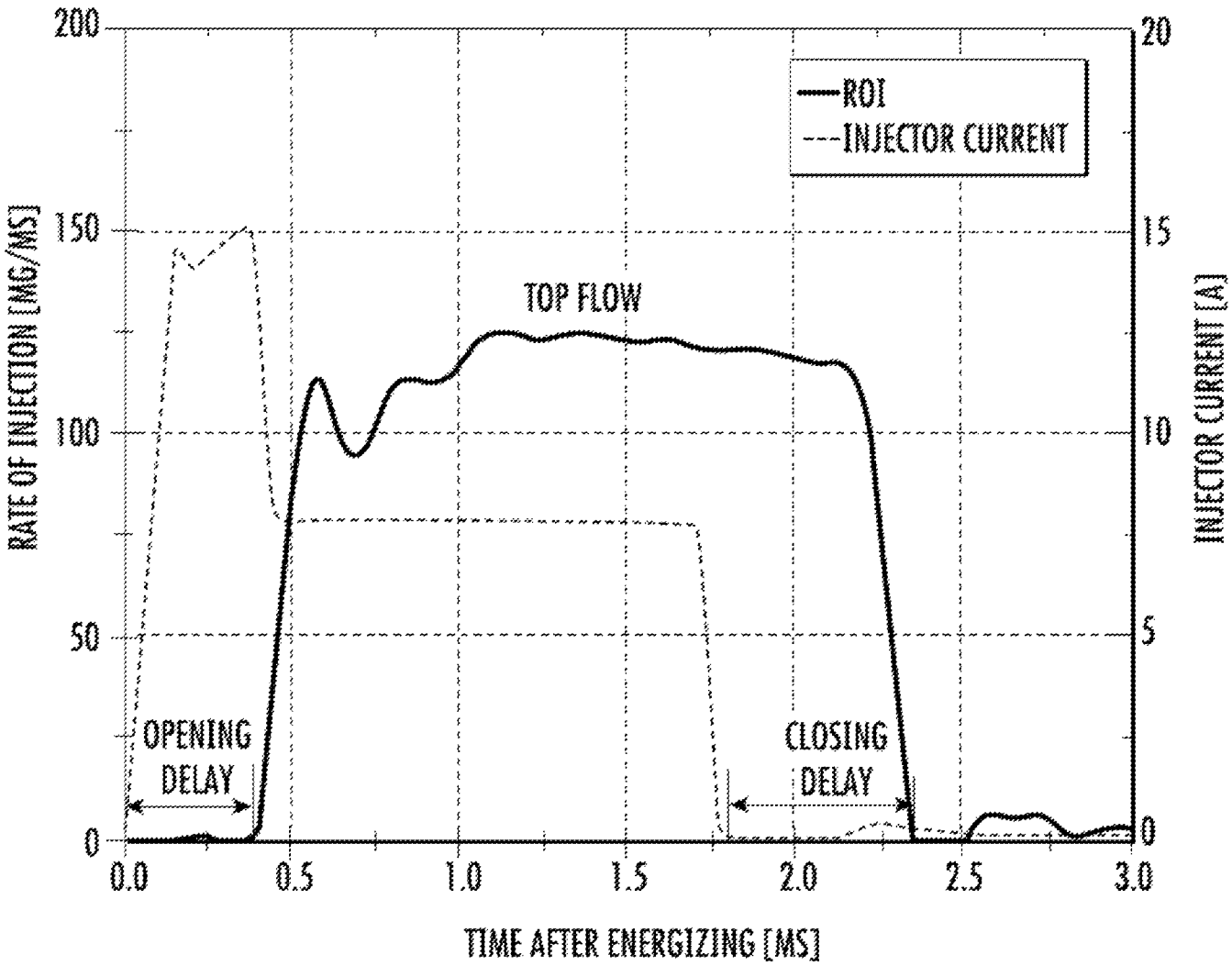
FIG. 1B shows an example ROI profile in accordance with aspects of the present disclosure.

During operation, and as shown in FIG. 1B, the rate of injection for each of the fuel injectors 107 can be profiled. This profile of a fuel injector can also be referred to herein as a rate-of-injection (ROI) profile. The ROI profile can be a graph that shows time after energizing in milliseconds (ms) (e.g., via the electrical current 121) along the X-axis and rate of injection (or mass flow rate) in milligrams per millisecond (mg/ms) along the Y-axis. As can be seen in the example of FIG. 1B, the fuel injector has an opening delay of approximately 0.5 milliseconds after being energized. Following the opening delay, a steep rise in fuel output occurs, followed by a relatively steady-state fuel output referred to herein as a top flow. Following the top-flow, de-energizing of the fuel injector occurs, and a closing delay of approximately 0.5 ms occurs before fuel output ceases.

The injector current profile, as shown in the example ROI of FIG. 1B, indicates an electrical command to the injector to activate the fuel injection/output event. In operation, there are opening and closing delays between the actual injection event and the injector command/current profile.

Figure 1C:
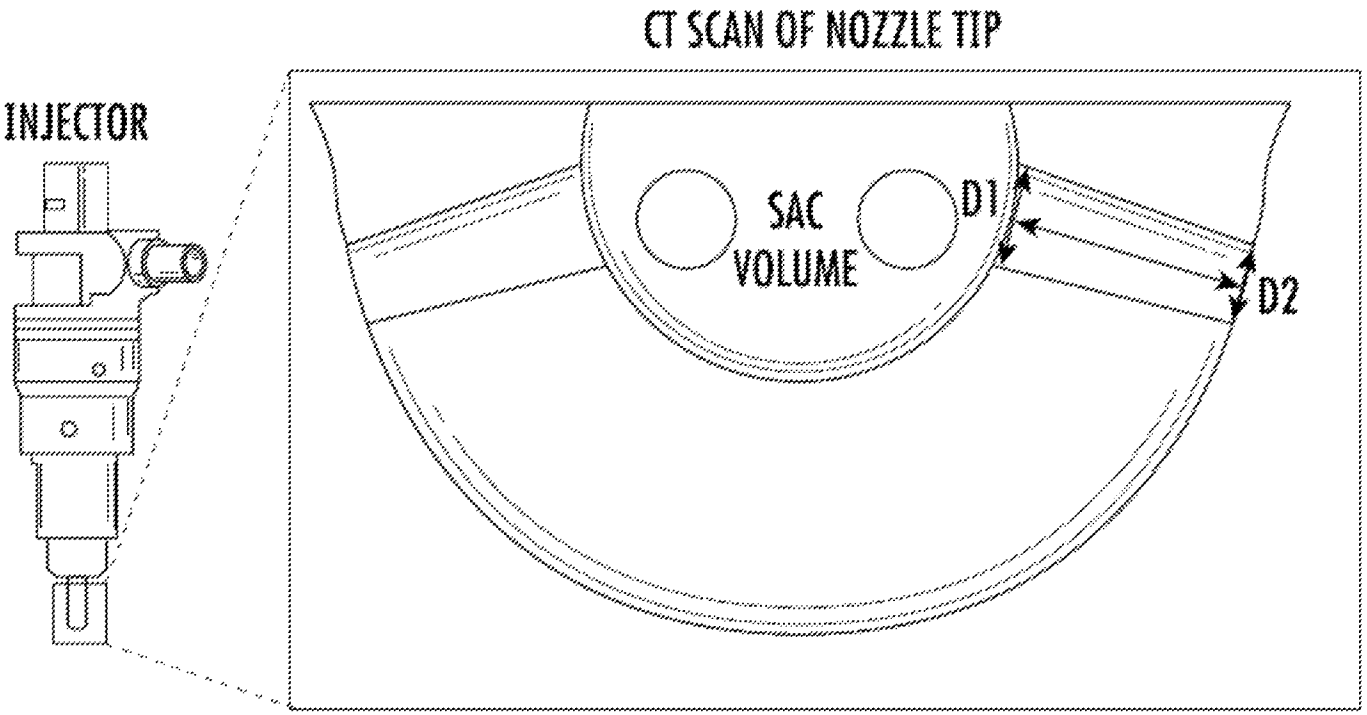
FIG. 1C shows an example computed tomography (CT) scan of a nozzle tip of a fuel injector.

Various factors impact the corresponding ROI profile for a fuel injector. FIG. 1C shows an example computer tomography (CT) scan of a nozzle tip of a fuel injector. As can be seen, the internal geometry of the fuel injector has a cavity, known as a fuel sac or simply a SAC, which has a relatively small volume. The output ports fluidly coupled to the SAC of the fuel injector each have a length (L) and can include a first end with a first diameter (D1) and a second end with a second diameter (D2).

Figure 1D:
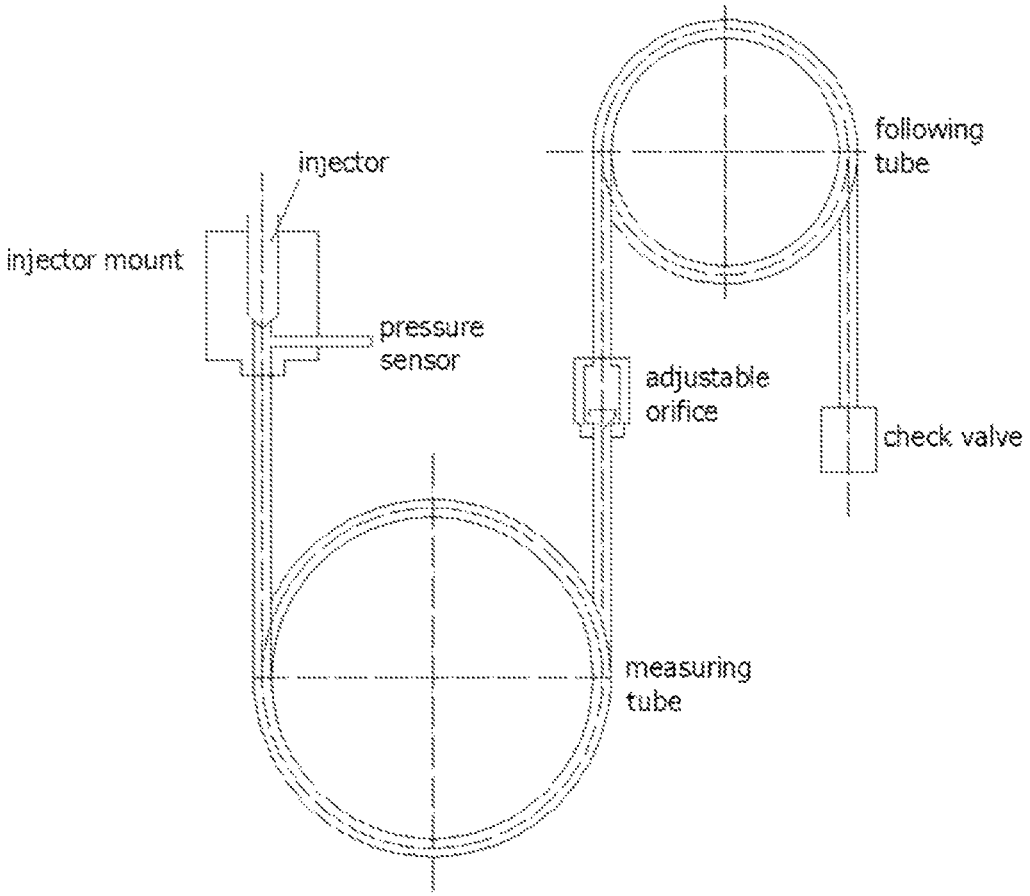
FIG. 1D shows an example Bosch-tube arrangement that can be used to measure the mass flow rate of a fuel injector in accordance with aspects of the present disclosure.

FIG. 1D shows an example Bosch-tube arrangement that can be used to measure the mass flow rate of a fuel injector. The Bosch-tube arrangement can be used to capture a plurality of pressure values over an injection cycle for a fuel injector under test. As discussed in further detail below, the rail/tube pressure of the Bosch-tube arrangement can be set to a predetermined pressure and the injection duration, e.g., the amount of time a driving current is applied to the fuel injector under test, can be set to a predetermined duration. The particular combination of set operating conditions used during test/measurement iterations can be referred to as a target operating condition or simply a target condition. Preferably, a plurality of injection cycles for the fuel injector under test is executed for the target condition. The pressure values (e.g., as reported by a pressure sensor of the Bosch-tube) over a given injection cycle are then sampled at a predetermined rate, e.g., 10 kilohertz (kHz) and preferably stored as a set/array in memory. A plurality of such sets may then be associated with the target condition and used during filtering/selection as discussed in further detail below. Additional target condition(s) may then be tested, and corresponding measurement sets can be produced and stored in memory, to preferably cover a range of target rail pressures and/or injection durations. These measurement sets stored in the memory may be used by a ROI process consistent with the present disclosure to generate a predicted ROI profile, as discussed further below.

Figure 2:
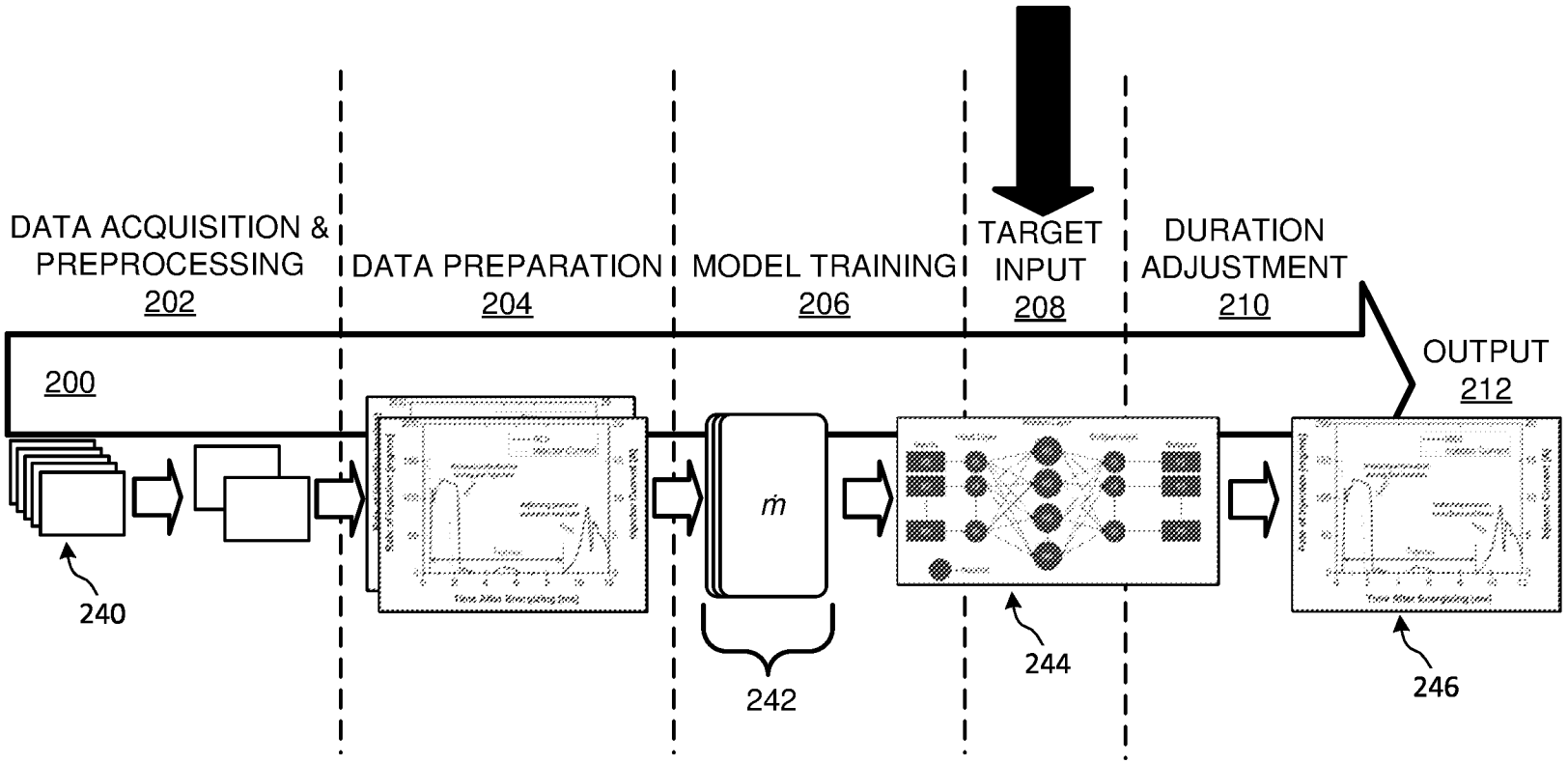
FIG. 2 shows a block diagram of an example ROI generation process, in accordance with aspects of the present disclosure.

FIG. 2 shows an example process 200 for determining a ROI profile for a fuel injector consistent with aspects of the present disclosure. The process 200 may also be referred to herein as an ROI process. The process 200 preferably includes a plurality of stages, namely a data acquisition and preprocessing stage 202 (referred to herein as a preprocessing stage for simplicity), a data preparation stage 204, a model training stage 206, a target input stage 208, an optional duration adjustment stage 210, and an output stage 212. Note, the process 200 may include more or fewer stages and the particular configuration shown in FIG. 2 is not intended to be limiting.

Each stage of the process 200 is preferably implemented by a controller, such as the ECU 119 shown in FIG. 1A. However, the controller may be implemented as other controller types such as an application-specific integrated circuit (ASIC) or a reprogrammable hardware device such as a field-programmable gate array (FPGA). The controller may be implemented within a vehicle, such as within an engine/fuel control system, or may be implemented in other configurations such as within a server computer or a mobile device (e.g., a laptop or smart phone).

Each stage of the process 200 can be implemented via hardware, software, or a combination thereof. More preferably, each stage of the process 200 may be implemented via hardware and/or software of a server computer, or a plurality of server computers coupled with each other via a network. The process 200 may also be implemented whole, or in part, via a non-transitory computer-readable medium. The computer-readable medium can be configured to store instructions that when executed by a controller of a computer device, e.g., the ECU 119 of FIG. 1A, cause the controller to perform a method for determining a rate-of-injection (ROI) profile for a fuel injector consistent with the present disclosure. One such example method is shown as process 200.

The preprocessing stage 202 preferably includes a controller receiving a first plurality of measurement sets 240 for a fuel injector. Each measurement set of the plurality of measurement sets 240 preferably corresponds to an injection cycle. These injection cycles of the fuel injector may be measured via a measurement arrangement such as the Bosch-tube assembly shown in FIG. 1D and described above.

More preferably, each measurement set of the plurality of measurement sets 240 corresponds to an injection cycle of a fuel injector while operating an associated fuel rail (or fuel tube) at a first target pressure, which may also be referred to herein as a first target rail pressure, and while driving the fuel injector to output fuel for a first predetermined duration, which may also be referred to herein as first injection duration. This combination of the first target pressure and the first predetermined duration may also be referred to herein as a first operating set point or first operating condition.

An injection cycle as generally referred to herein is defined as a predetermined period of time that begins at T0 with the energizing of the fuel injector and ends at T0+1, with the end of the injection cycle being initiated by de-energizing of the fuel injector and being defined as the moment which output of the fuel injector is effectively zero (0 mg/ms). One such example injection cycle is shown in the example ROI profile of FIG. 1B.

Accordingly, each measurement set of the first plurality of the measurement sets 240 corresponds to an injection cycle while operating the fuel injector at the first operating set point. The first operating set point preferably includes a first target pressure in a range of 500 bar to 2,500 bar, or more preferably in a range of 600 bar to 2000 bar. However, this disclosure is not limited in this regard, and the target rail pressure can vary depending on a desired application.

Each measurement set of the first plurality of the measurement sets 240 preferably includes a plurality of pressure measurement values based on a predetermined sampling rate. Preferably, the predetermined sampling rate for a given injection cycle is in a range of 1 to 20,000 kilohertz (kHz), or 5 kHz to 15 kHz, or more preferably 10 kHz. Therefore, the plurality of pressure measurements may be a plurality of decimal values that are ordered relative to time. For example, the first decimal value can correspond to a pressure measurement at T0; the second decimal value can correspond to a pressure measurement at T0+N, and so on.

Preferably, the first plurality of measurement sets 240 includes at least two measurement sets. In one example, the first plurality of measurement sets 240 includes a total number of measurement sets in a range of 10 to 100 measurement sets. More preferably, the total number of measurement sets is less than 250 measurement sets given the overall amount of time to complete each injection cycle and to perform measurements thereof.

Figure 3:
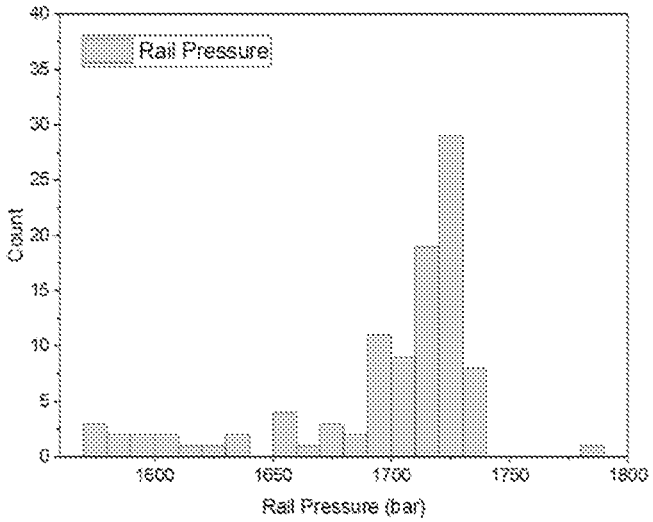
FIG. 3 shows an example histogram showing a distribution of an example plurality of rail pressure values before injection in accordance with aspects of the present disclosure.

Continuing with the preprocessing stage 202, the controller preferably determines a target standard deviation to utilize as a threshold based on the first plurality of measurement sets 240. In one example, the controller determines the target standard deviation by analyzing the distribution of the first plurality of measurement sets 240. For instance, consider a scenario where one hundred (100) measurement sets were produced for a fuel injector using a Bosch-tube assembly set to a target pressure of 1600 bar. The resulting measurement sets in this example can vary in pressure from, for example, 1550 bar to about 1780 bar. FIG. 3 shows an example histogram 300 for the one hundred measurement sets for purposes of illustration. As demonstrated by the distribution of the histogram 300, a majority of the measurement sets included a measured pressure within the 1650 to 1725 range. The resulting overall standard deviation (σ) for the measurement sets may therefore be about 43.26 bar in this example. However, the one hundred measurement sets can also include a relatively smaller standard deviation for those measurement sets in the 1725 bar range. In this example, twenty-nine (29) of the measurement sets at about 1725 bar had a standard deviation (σ) of less than 2.88 bar. This 2.88 bar, therefore, represented the lowest standard deviation for the measurement sets. Thus, the preprocessing stage 202 preferably includes selecting/identifying those measurement sets having the lowest overall standard deviation, which is to say, having a standard deviation of equal to or less than the target deviation (e.g., 2.88 bar). Note, as few as a single measurement set may be selected during the preprocessing stage 202. However, the selected number of measurement sets is preferably at least two measurement sets.

The preprocessing stage 202 further preferably includes receiving N number of measurement sets based on a range of different operating set points for the fuel injector. For example, the preprocessing stage 202 can receive at least a second plurality of measurement sets. The second plurality of measurement sets preferably corresponds to a second operating set point/condition. The second operating set point is preferably different than the first operating set point. For example, the second operating set point can include a second target pressure that is different from the first target pressure and/or a second predetermined duration for each injection cycle that is different from the first predetermined duration. The particular number of measurement sets and variations therebetween may therefore be selected based on a desired configuration. For instance, it may be desirable to utilize tens of different measurement sets that represent a range of different target pressures, a range of different predetermined duration for injection cycles, or both.

In any event, the controller preferably selects/identifies from each received measurement set those measurement sets that have a standard deviation at or below a target standard deviation (or simply put, those measurement sets that have the lowest overall standard deviation), as discussed above.

During the data preparation stage 204, the controller then determines an average ROI profile for each operating set point represented by the measurement sets selected during the preprocessing stage 202.

An ROI can then be calculated for each measurement set of the first plurality of measurement sets 240 based on the following equation:

$$\dot{m} = A_{cross} * \frac{P(t)}{c} \qquad \text{Equation (1)}$$

with ($\dot{m}$) being the mass flow rate, ($A_{cross}$) being the known cross-sectional area of the tube, (c) being the speed of sound within the tube, (P(t)) being the measured pressure rise. The speed of sound (c) in the fuel can be determined based on the following equation:

$$c = 2 * \frac{L}{t_{reflection}} \quad \text{Equation (2)}$$

where (L) is the tube length, and ($t_{reflection}$) is the measured reflection time.

Figure 4:
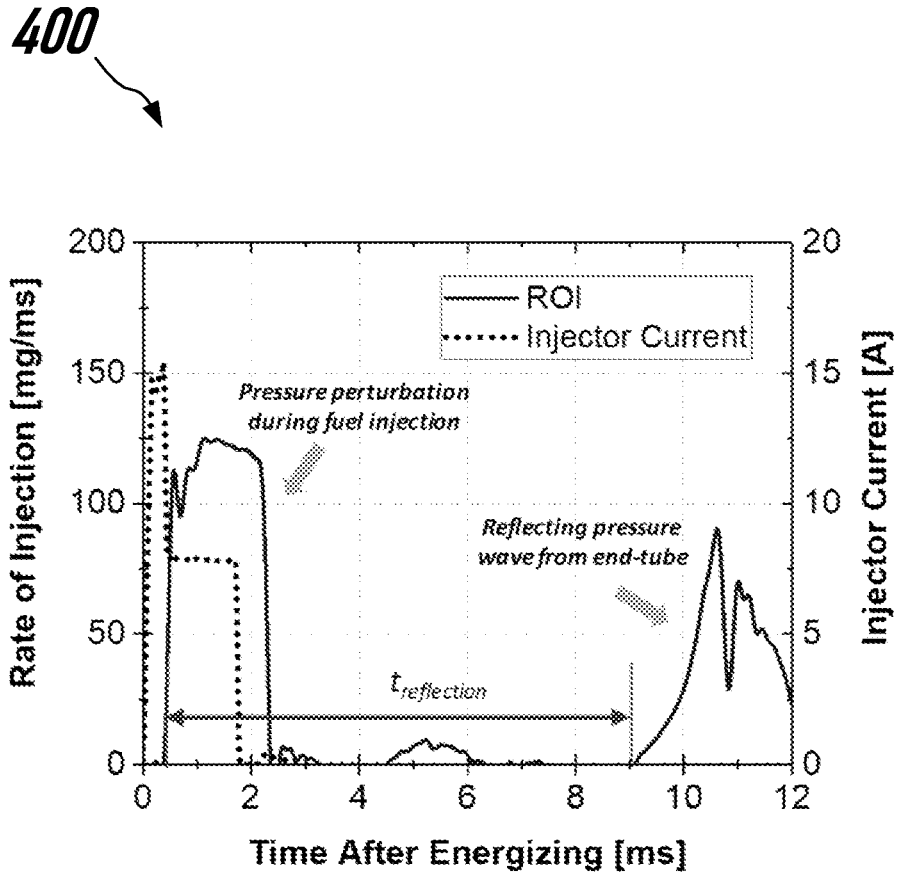
FIG. 4 shows a graph that illustrates the pressure wave that reflects from the end of a tube during an injection cycle, in accordance with aspects of the present disclosure.

The time interval ($t_{reflection}$) is the total time it takes for the pressure wave generated by the fuel injection event (near injector nozzle tip) to travel to the end of a tube (e.g., of a Bosch-tube assembly) and reflect back to a pressure sensor which is disposed near the injector nozzle tip. FIG. 4 shows a graph that illustrates the pressure wave that reflects from the end of the tube during an injection cycle.

Experimental testing identified that the speed of sound in the diesel-filled fluid was approximately 1520 m/s. Testing revealed that the influence of pressure and temperature on the speed of sound was negligible as the same remained relatively unchanged throughout the injection cycles. Likewise, testing demonstrated that the overall duration of the injection event (e.g., the total amount of time the fuel injector outputs fuel during a given injection cycle), remains the same and follows the driving current duration (see FIG. 4; injector current plot) when performing injection cycles at a particular target rail pressure.

Figures 5A, 5B:
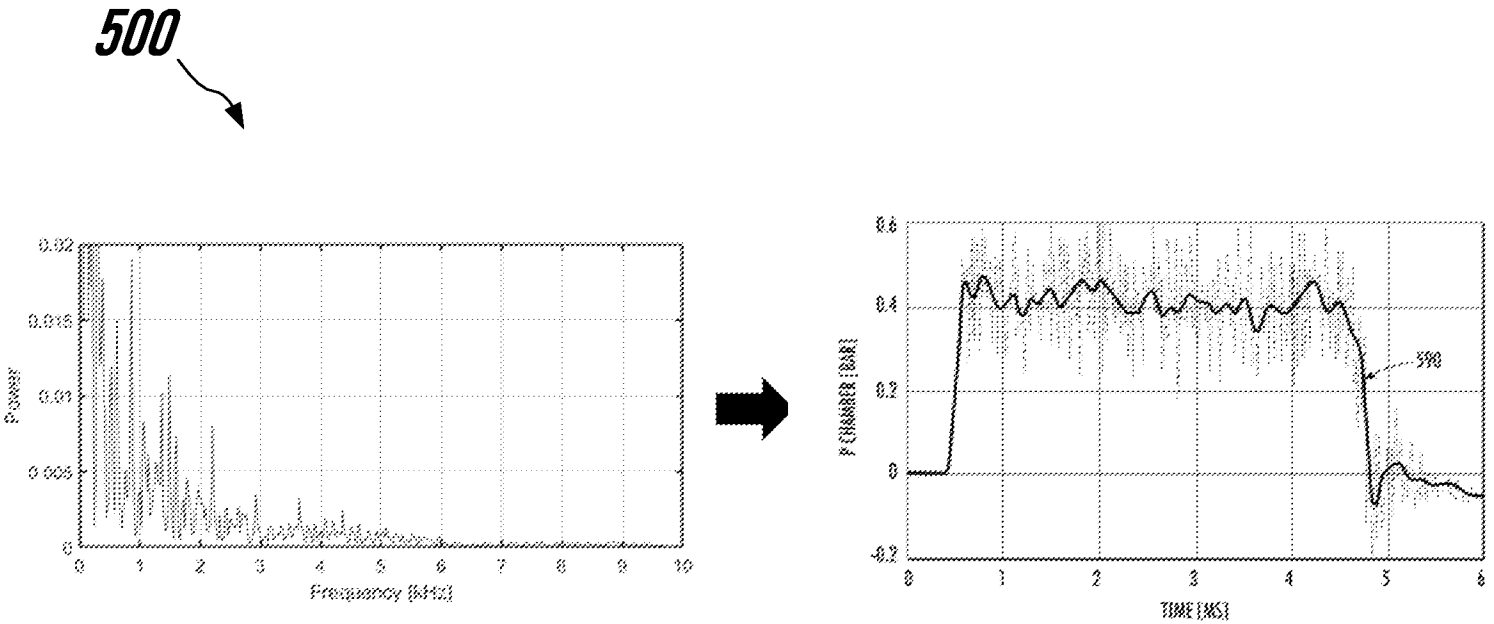
FIG. 5A shows a graph of the power spectrum for the raw measurements of one example first plurality of measurement sets, in accordance with aspects of the present disclosure.
FIG. 5B shows the result of filtering the raw measurements using a 5 kHz low-pass filter, in accordance with aspects of the present disclosure.

Equations 1 and 2 above allow for the determination of ROI from pressure measurements. Consider the following example. The first plurality of measurement sets can include a plurality of raw measurement values that were sampled at a predetermined rate, e.g., 10 kHz, as discussed above. FIG. 5A shows a graph of the power spectrum for the raw measurements of one example first plurality of measurement sets. A low-pass filter may then be applied to the raw measurements to attenuate noise from the pressure data and produce de-noised measurements, which is shown as most pronounced in FIG. 5A between 0.1 and 3 kHz. Thus, the power spectrum can be utilized to identify a noise threshold, and the identified noise threshold may then be utilized to select a low-pass filter for de-noising. For instance, a 5 kHz low-pass filter can be applied in the current example. This 5 kHz low-pass filter was identified as particularly well suited for filtering the raw measurement values of the current example as it corresponded with the frequency at which the tip of the fuel injector opened/closed during the injection cycle. FIG. 5B shows the result of filtering the raw measurements with the 5 kHz low-pass filter to produce a filtered signal 590. The removed/filtered noise is shown transposed in FIG. 5B relative to the filtered signal 590 for reference purposes.

In some cases, the length of the internal fuel tubing within a fuel injector can be determined, e.g., based on manufacturer-provided data. This length of the internal fuel tubing may be utilized to calculate a filter frequency value, e.g., for application as a low-pass filter as discussed above, based on the following equation:

$$d = \frac{c}{f} \quad \text{Equation (3)}$$

with (d) being two times the length of the fuel tube of the fuel injector, (c) being the speed of sound, and (f) being the nozzle frequency of the fuel injector.

In any event, the data preparation stage 204 (FIG. 2) generates an average ROI profile for the first plurality of measurement sets 240 that correspond with Condition 1. This averaged ROI profile is represented herein by the mass flow rate symbol $\dot{m}$. More preferably, the data preparation stage 204 generates a plurality of averaged ROI profiles 242, with each averaged ROI profile of the plurality of averaged ROI profiles 242 corresponding with a different operating condition. Note, the plurality of different operating conditions can cover, for example, a range of different target rail pressures, injection durations, or both.

In the model training stage 206, the controller instantiates/generates a ROI model 244 based on the output, e.g., one or more averaged ROI profiles, from the data preparation stage 204.

Figure 6:
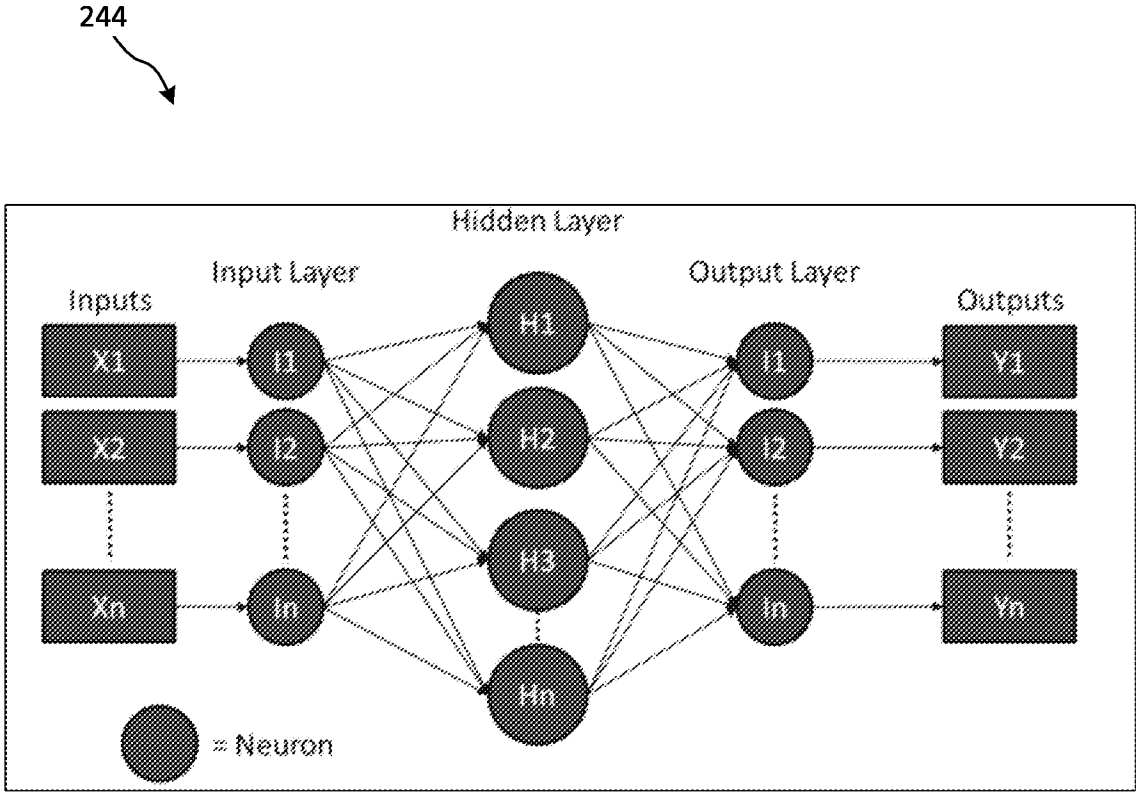
FIG. 6 shows an example structure of a Multi-Layer Perception (MLP) neural network, in accordance with aspects of the present disclosure.

The ROI model 244 is preferably implemented as a machine learning model and more preferably a machine learning model implemented as a neural network. Neural networks can utilize input and output data to build layers of "neurons" that are analogous to human brain neurons and can determine a relationship between the provided input and output data. One such machine learning model particularly well suited to learning and predicting ROI profiles consistent with the present disclosure is a multilayer perceptron (MLP). Thus, the ROI model 244 is preferably implemented as a MLP neural net. FIG. 6 shows an example of the ROI model 244 implemented as a MLP neural net.

As shown in FIG. 6, the MLP neural net includes an input layer, a hidden layer, and an output layer. Each neuron for a given layer is directly connected to the following layer's neurons. In the specific context of ROIs, the inputs preferably include at least a first input for target rail pressure or target mass flow rate. The hidden layer comprises N neurons based on the averaged ROI profile(s) output from the data preparation stage 204. Each line of connection between neurons in the hidden layer is representative of a weight/bias. The MLP neural net can be trained to predict ROIs consistent with the present disclosure by generating the layers shown in FIG. 6 and adjusting the weights/bias during a training routine.

In one particular configuration, the MLP neural net has a hidden layer size of one hundred (100) neurons and a maximum iteration value of 10^9. This hidden layer size can be other values, but preferably a value in a range of 300 to 1000 neurons, or at least 300 neurons, to allow the model to converge within the maximum iterations. Likewise, the maximum iteration value can be other values, but preferably in a range of 10^6 to 10^9 to cause the model to overfit and converge due to the relatively small amount of training data output by the data preparation stage 204. The outputs preferably include at least a first output of a predicted ROI profile, e.g., as Y1.

In the target input stage 208, the controller receives a first target pressure value for the fuel rail, and a target operational set point for the fuel injector. The target operating set point can be a desired mass flow rate or a desired injection duration.

The controller then generates a first ROI profile 246, which may also be referred to herein as a first predicted ROI profile, by inputting the first target pressure value and the target operational set point into the ROI model 244.

The controller may then adjust the duration of the first ROI profile 246 during the optional duration adjustment stage 210 to match a desired injection cycle duration. One example process for adjusting the duration of a predicted ROI profile is discussed further below.

The controller may then output the first ROI profile 246 in the output stage 212. An engine control unit, such as the ECU 119 (FIG. 1A), may utilize the first ROI profile 246 to adjust an operational characteristic of an engine such as a 2017 Volvo D13. In one example, the ECU 119 can implement an AI-driven engine control process that can adjust injector behavior to achieve a desired mass flow rate, e.g., to increase fuel efficiency during the operation of the vehicle. In another example, the ROI profile 246 can be used as an input within a CFD simulation to simulate engine/fuel system performance.

Figure 7:
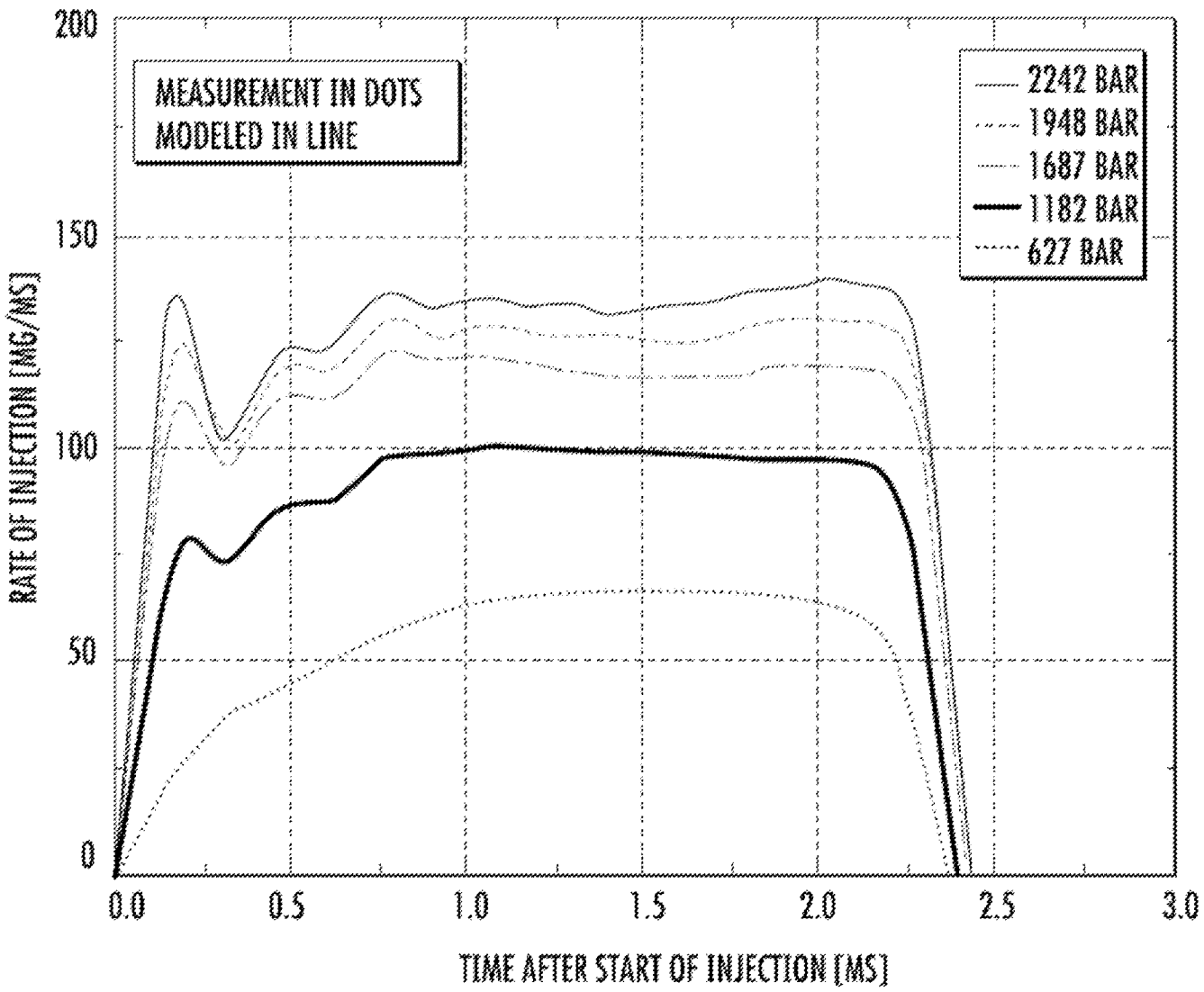
FIG. 7 is a graph that shows predicted ROI profiles generated via a machine learning model consistent with the present disclosure are substantially identical to the corresponding measured ROI profiles over a range of rail pressures.

FIG. 7 is a graph that shows that predicted ROI profiles generated via a machine learning model consistent with the present disclosure are substantially identical to the corresponding measured ROI profiles over a range of rail pressures.

Experimental Results

ROI profiles were captured using a Bosch-tube method. This method operates on the principle that pressure rises in a tube/fuel rail due to high-pressure diesel fuel being injected into the cavity medium. The medium used during the experiments was the same with injected diesel fuel.

A pressure sensor, placed on the side of the inlet tube, detected the pressure change (See FIG. 1D). Table 1, which is shown in FIG. 8A provides information on the overview of the fuel and data acquisition (DAQ) systems, including a high-pressure hydraulic pump that can deliver up to 6000 bar and a production Delphi F2E (non-pumping) injector. The control and measurement system included a National Instrument (NI)-based data acquisition (DAQ) system. Table 2 which is shown in FIG. 8B summarizes the test conditions with 100 injection cycles per run/iteration. A precision scale was used to capture the total accumulated mass of fuel output by the fuel injector under test.

The testing setup described in Tables 1 and 2 was used to record/measure rate-of-injection and injector current measurements for various rail pressures and injection cycle durations at a rate of 10 kHz. Each condition measured, e.g., each combination of rail pressure and injection cycle duration was then stored as a different/distinct measurement set in a memory. Accordingly, in this example, each measurement set included the data from one hundred injection cycles.

The plurality of measurement sets were then analyzed and characterized to design a model for predicting the injector's ROI profile. The following details one example process for creating the model (which may also be referred to herein as an empirical model), and a process by which an ROI profile with a target duration can be generated. The target duration can be less or greater than the duration used for each injection cycle that was used to train the model.

Figure 9A:
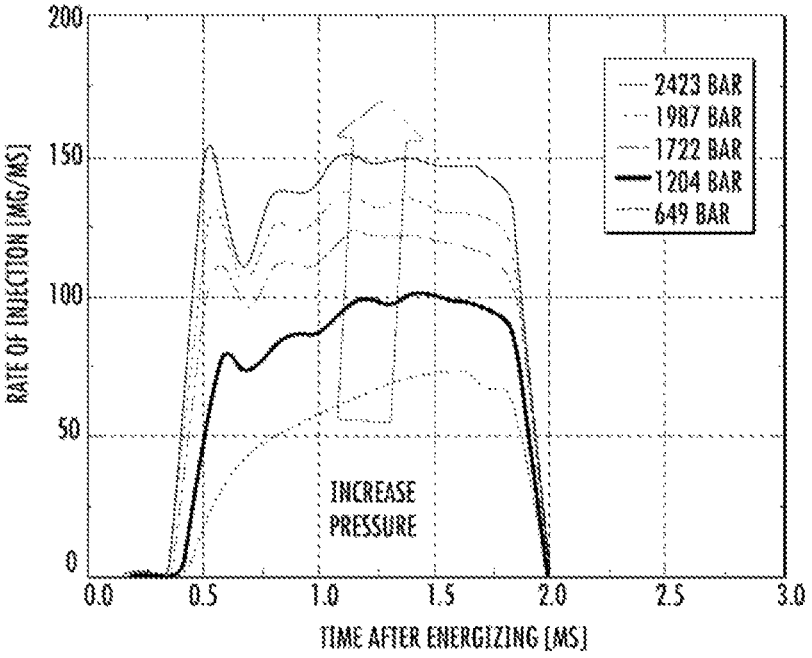
FIG. 9A shows ROI profiles for the same commanded pulse of 1.6 milliseconds (ms) duration at various rail pressures.

FIG. 9A shows the calculated ROI profiles based on the plurality of measurement sets (e.g., with a first measurement set corresponding to 649 bar; a second measurement set corresponding to 1204 bar; a third measurement set corresponding to 1722 bar; a fourth measurement set corresponding to 1987 bar; and a fifth measurement set corresponding to 2423 bar). As shown, the ROI curves for different rail pressures have similar overall shapes. In each case, the injection rate does not start to rise until approximately 0.4 ms after energizing the injector via a driving current. Therefore, the present disclosure has identified that this delay is specific to the injector itself and is independent from that of the particular rail pressure.

For rail pressures 1204 bar and above, a rapid initial rise in injection rate is seen from approximately 0.4 ms to 0.5 ms, followed by a complex curve consisting of sine-like behavior that trends upwards and reaches "quasi" steady flow after about 1.25 ms. The magnitude of the sine-like behavior strongly correlates with rail pressure; the higher the rail pressure, the faster the ramp-up and ramp-down are. For the 649 bar pressure, neither the sine-like behavior nor the settling behavior are observed, but the injection rate still trends upwards with decreasing slope. This data suggests that the 649 bar curve would settle into a steady-state for a longer pulse duration similar to that seen in the higher pressures.

Figure 9B:
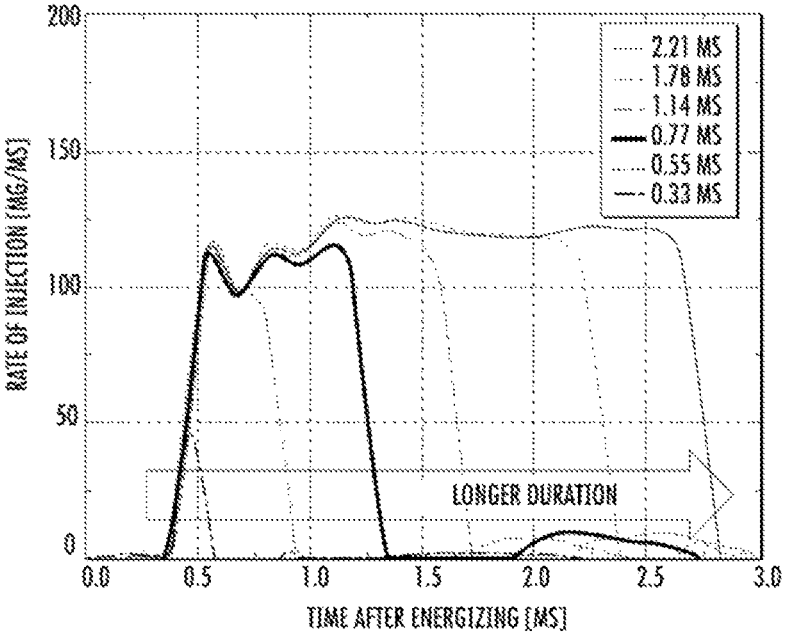
FIG. 9B shows ROI profiles for the same commanded rail pressure of 1722 bar at various pulse durations.

FIG. 9B also shows ROI profiles for a commanded rail pressure of 1722 bar at various pulse durations. For those curves with relatively longer pulse durations, the injection rate initially increased rapidly as the injector opened, followed by a pulsation that settled at a near-constant rate of injection. Finally, a rapid pressure drop is observed as the fuel injector closes. For shorter duration pulses, the curve can initially follow the same trend but end/cease before the pulsation, or near-constant injection rate occurs.

As shown, the near-constant injection rate is, therefore, more pronounced in the data for injection durations over 1.78 ms. It should also be noted that, for each injection duration, the rapid rise and fall slope at the beginning and end of each injection have corresponding slopes of nearly identical magnitude. This behavior is seen in the "0.33 ms" and "0.46 ms" data as it is responsible for the inverted V shape of the curve. These curves were observed as effectively symmetrical about their peaks. This data suggests that each injection cycle's initial and ending behavior will not change relative to the selected injection duration. For durations of greater than 2 ms, only the duration of the near-constant rate of injection will increase. This observation advantageously allows for the derivation of models consistent with the present disclosure to represent the ROI curves.

Figure 10:
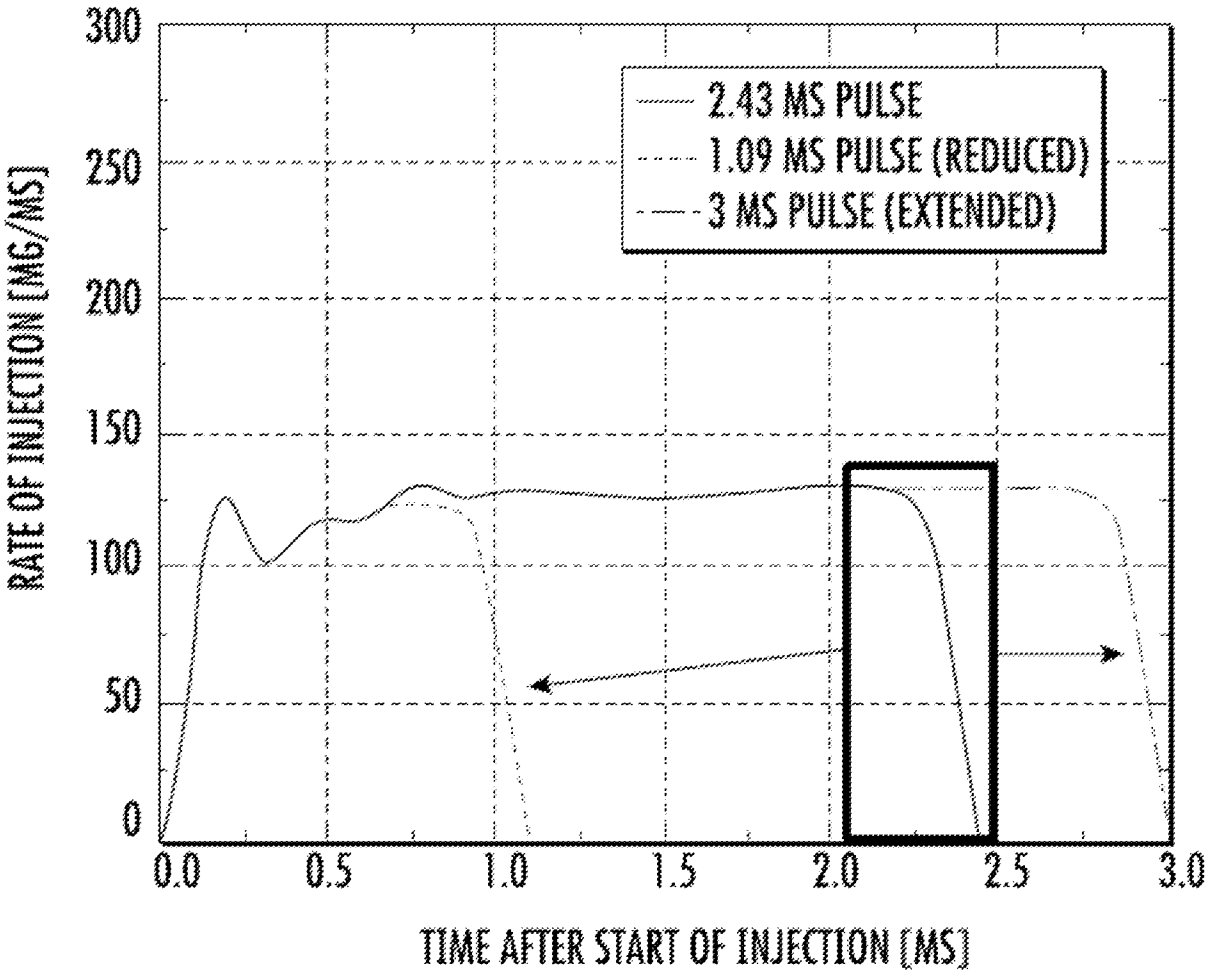
FIG. 10 demonstrates aspects of a method for predicting/determining ROI curves of shorter or longer durations than the available measured data.

FIG. 10 demonstrates aspects of a method for predicting/determining ROI curves of shorter or longer durations than the available measured data. FIG. 10 shows a measured ROI Profile at 1948 bar Rail Pressure ROI with Short (Reduced) and Long (Extended) Duration determined from a measured 2.43 ms injection duration.

Conclusions from the results of FIG. 10 were used to manually create predicted ROI curves at 1948 bar rail pressure for 1.09 ms and 3.0 ms pulse durations from the measured 2.43 ms pulse duration. The box and associated arrows illustrate how the end of the measured ROI profile (referred to herein as the cut portion) was shifted to create the reduced and extended profiles.

In particular, the cut portion was shifted horizontally for the reduced profile so that the desired pulse duration was achieved; then, the curve was shifted vertically until it intersected the measured data. For the extended profile, the cut portion was shifted horizontally until the desired pulse duration was achieved. The time difference was assumed to have a constant injection rate equal to the average injection rate from 1.9-2.1 ms.

Figure 11:
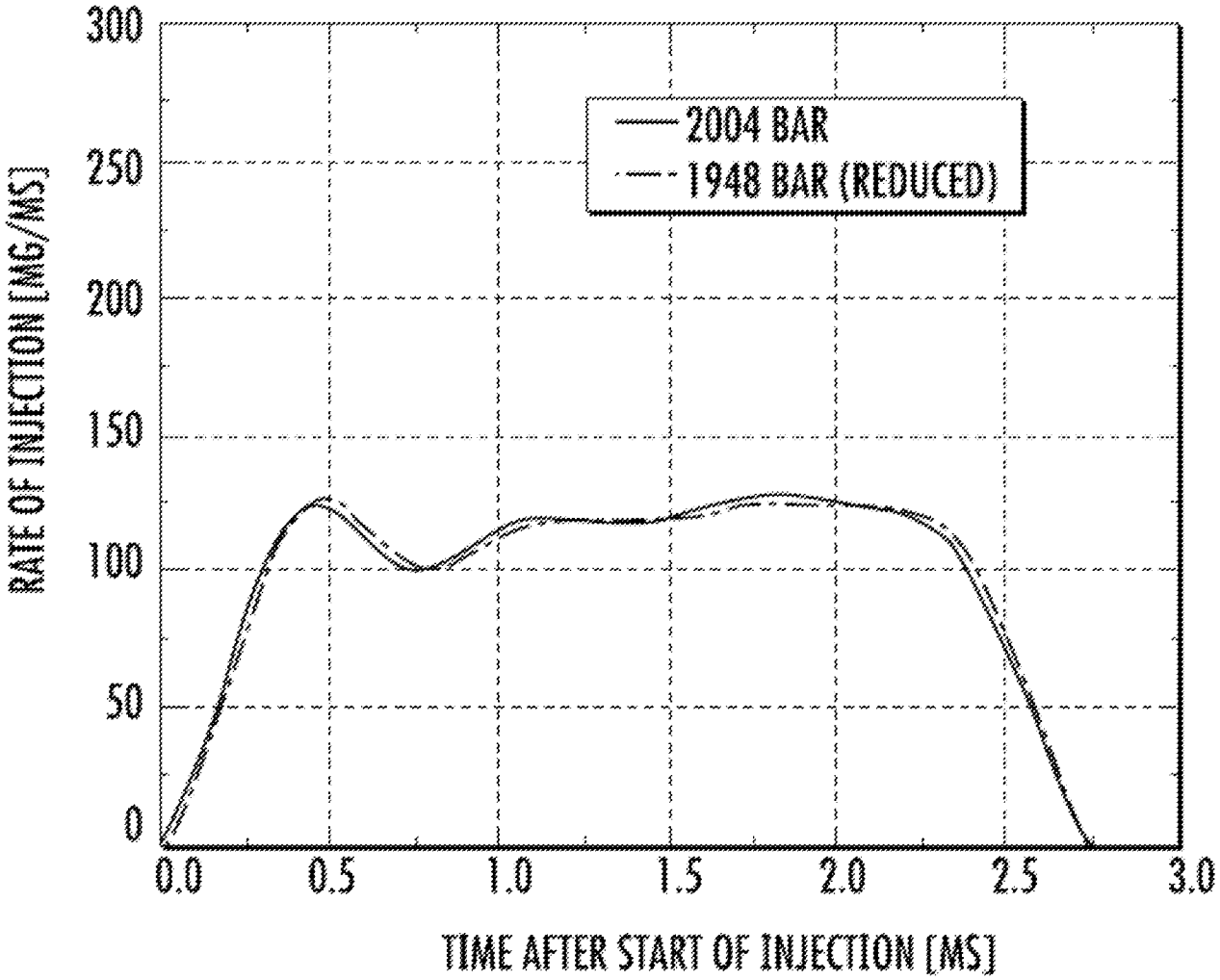
FIG. 11 shows a comparison between ROI profiles measured and generated via a method for predicting/determining ROI curves of shorter or longer durations consistent with aspects of the present disclosure.

FIG. 11 shows a comparison between ROI profiles of Same Actual Duration (1.09 ms): 2004 bar from measurement; 1948 bar derived from measurement using a section method as disclosed herein.

As shown in FIG. 11, the beginning of both profiles is nearly identical, as expected from the observations of FIGS. 9A-9B. FIG. 11 shows that although the injection rate fluctuates in the measured data shown in FIGS. 9A-9B, each curve's trends are substantially similar. FIGS. 9A-9B show that for each injection duration greater than 1 ms, the associated curve can be described as having the same initial and ending curve, separated by an approximately linear middle section. This linear middle section simply lasts longer for longer injection durations, and is shorter for shorter injection durations. For injection durations shorter than 1.0 ms, the injection rate does not have sufficient time to reach this approximately linear middle section. In this scenario, the fall-off in injection rate at the end of each injection occurs before the flow reaches that state.

Continuing on, the experimental result included a total measured accumulation of 110.03 milligrams (mg) and an estimated/derived accumulation of 110.25 mg using an ROI duration adjustment method/process consistent with the present disclosure.

FIG. 11 validates the disclosed approach for injection durations from an ROI profile, wherein the top flow is determined to be at a steady state. The curves in FIG. 11 are almost identical between measured and predicted, and the accumulation difference of 0.23 mg further reinforces the accuracy of the disclosed approach.

FIGS. 9A-9B show ROI data of various injection durations for different rail pressures. FIGS. 9A-9B show that rail pressures above 1000 bar each demonstrate notably similar behavior, while the 627 bar rail pressure data is an outlier.

Figure 12:
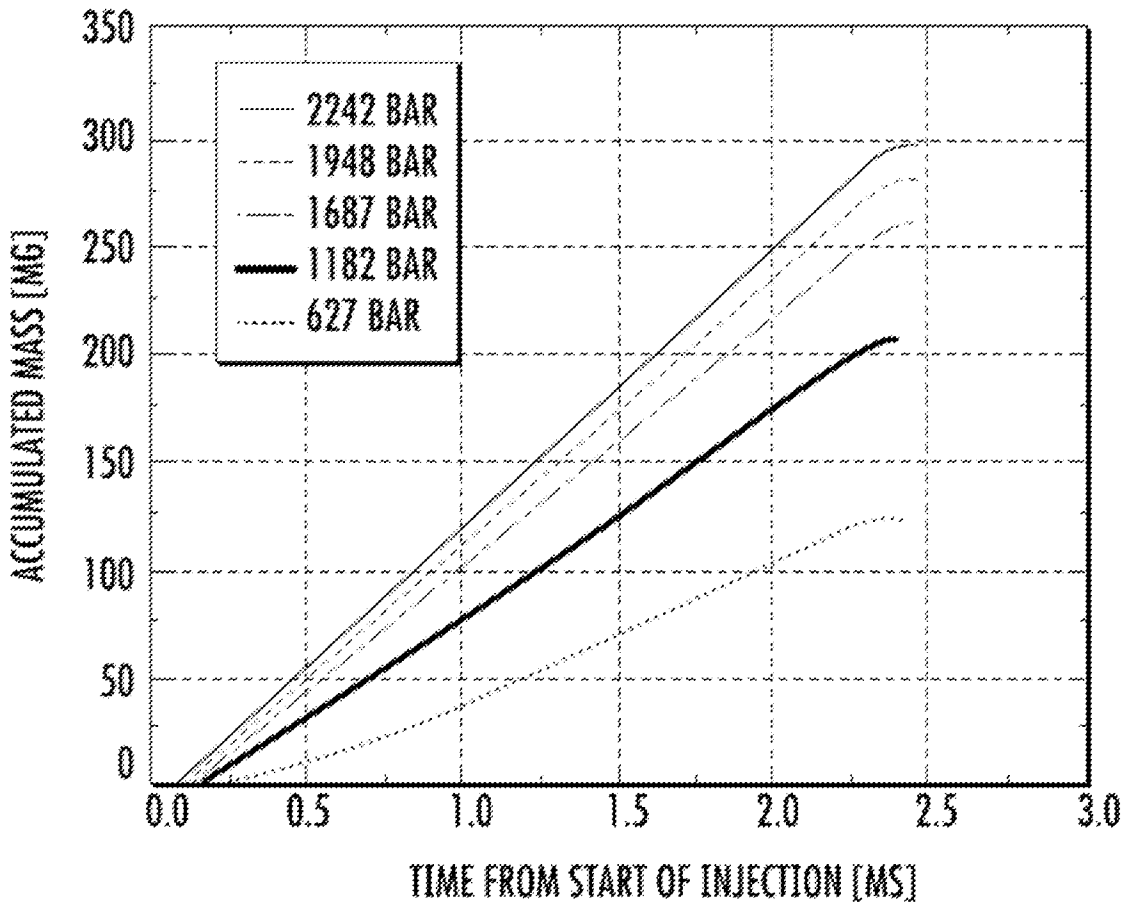
FIG. 12 shows accumulated mass for a range of different injection durations and rail pressures.

FIG. 12 shows accumulated mass for a range of different injection durations and rail pressures. FIG. 12 was generated by integrating the injection rate as shown in FIG. 9A at each point in time. FIG. 12 shows how, regardless of rail pressure, the injection rate pulsations have a minimal/negligible effect on the accumulation of fuel injected, particularly for durations longer than 0.5 ms and pressures above 1000 bar. The accumulation of ramp-up and ramp-down regions is non-linear, but a simple line/linear slope can accurately represent each top-flow region's accumulation.

Figure 13:
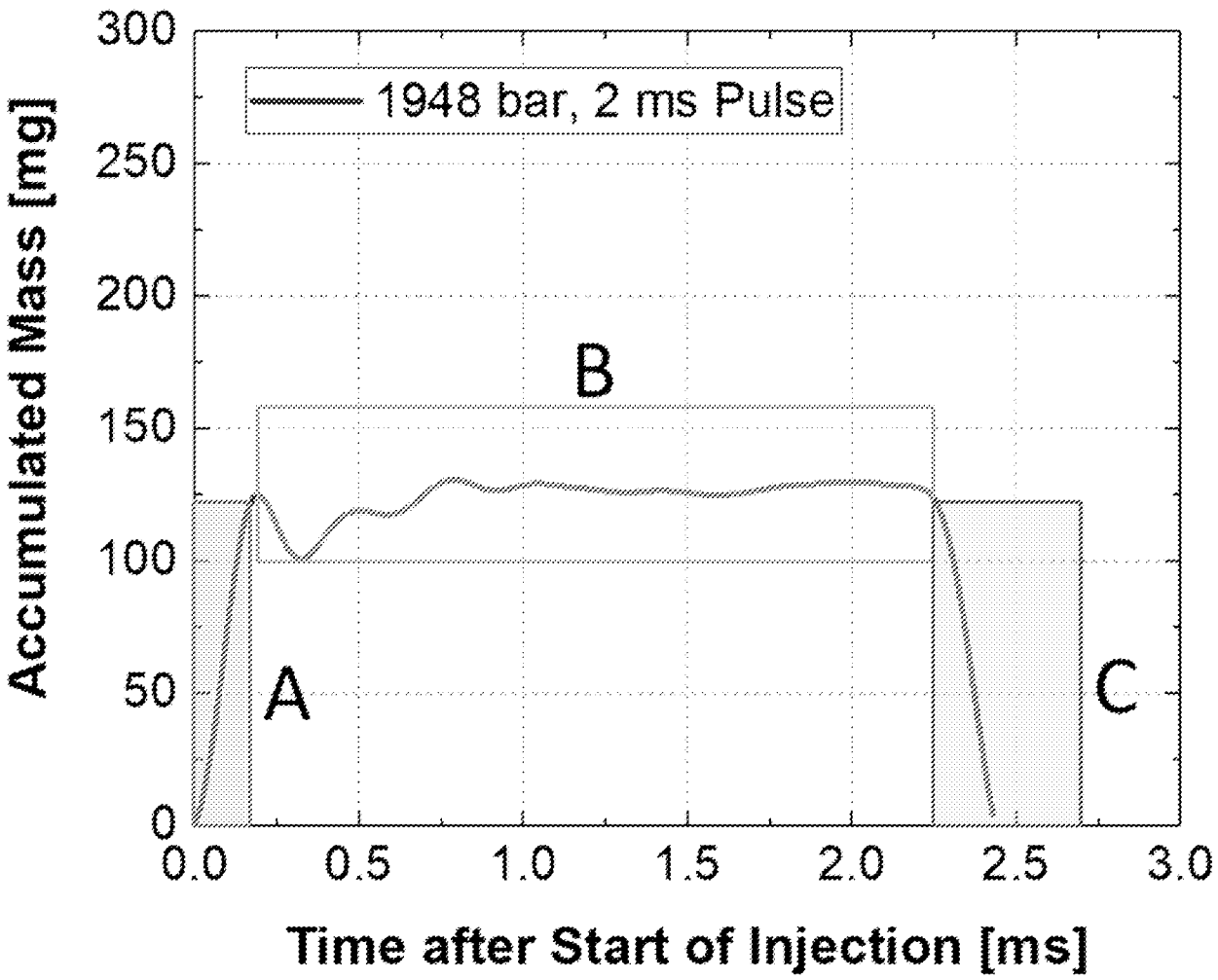
FIG. 13 shows an example approach of identifying/demarcating sections/regions of a ROI profile in accordance with aspects of the present disclosure.

To "fit" an empirical model to the measured ROI curves, the following steps were performed. First, the plot was separated into three (3) main component regions, namely Ramp-Up (A), Top-flow (B), and Ramp-down (C). FIG. 13 shows an example of this separation/demarcation. The main component regions are preferably isolated and are non-overlapping over time.

The ramp-up to top flow transition (approximately 0.3-0.5 ms) and top flow variation (about 0.5-1.75 ms) are apparent differences between lower and higher rail pressure data, as shown in FIGS. 9A-9B. Top flow, ramp-down, and the transition between each have a similar shape and change intensity at different pressures.

Figure 15:
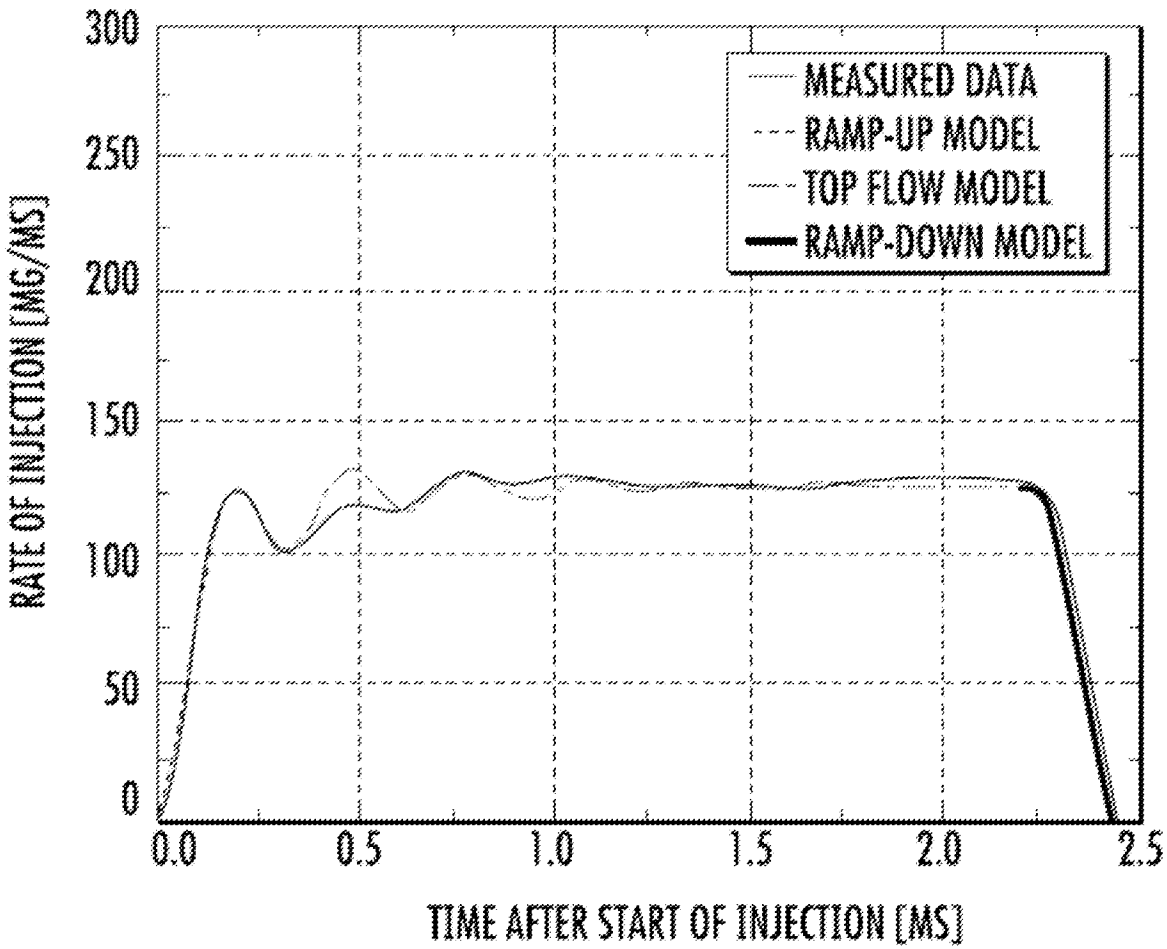
FIG. 15 shows an example empirical model of an ROI profile that was derived through a combination of the functions shown in FIG. 14, in accordance with aspects of the present disclosure.

Table 3 as shown in FIG. 14 provides example mathematical functions for categorizing each region of an ROI profile. FIG. 15 shows an example empirical model of an ROI profile that was derived through a combination of the functions of Table 3.

The empirical model for the ramp-up and ramp-down regions can be achieved via a linear fit to the measured data based on the following equation:

$$\dot{m}(t)=mt+b \qquad \text{Equation (4)}$$

In both ramp-up and ramp-down sections, the slope (m) is equal in magnitude but opposite in sign; the ramp-up section slope is positive, and the ramp-down section slope is negative. In the ramp-up section, the vertical shift (b) is equal to zero, while in the ramp-down section, the vertical shift is such that the injection rate is approximately zero at the desired injection duration.

The empirical model for the top flow region can be characterized via a function with a time-shift to force the cosine function to be equal to 1 at the peak of the initial pulse. The following is one such example function:

$$\dot{m}(t)=Xe^{-r(t-t_{pulse})}\cos(\omega(t-t_{pulse}))+X_2e^{-2t}+C \qquad \text{Equation (5)}$$

Where (X) is the initial amplitude, (r) is the decay constant, ($t_{pulse}$) is time offset for dampened cosine wave function, (ω) is angular frequency, and (C) is constant shift of exponential decay function.

Figure 16:
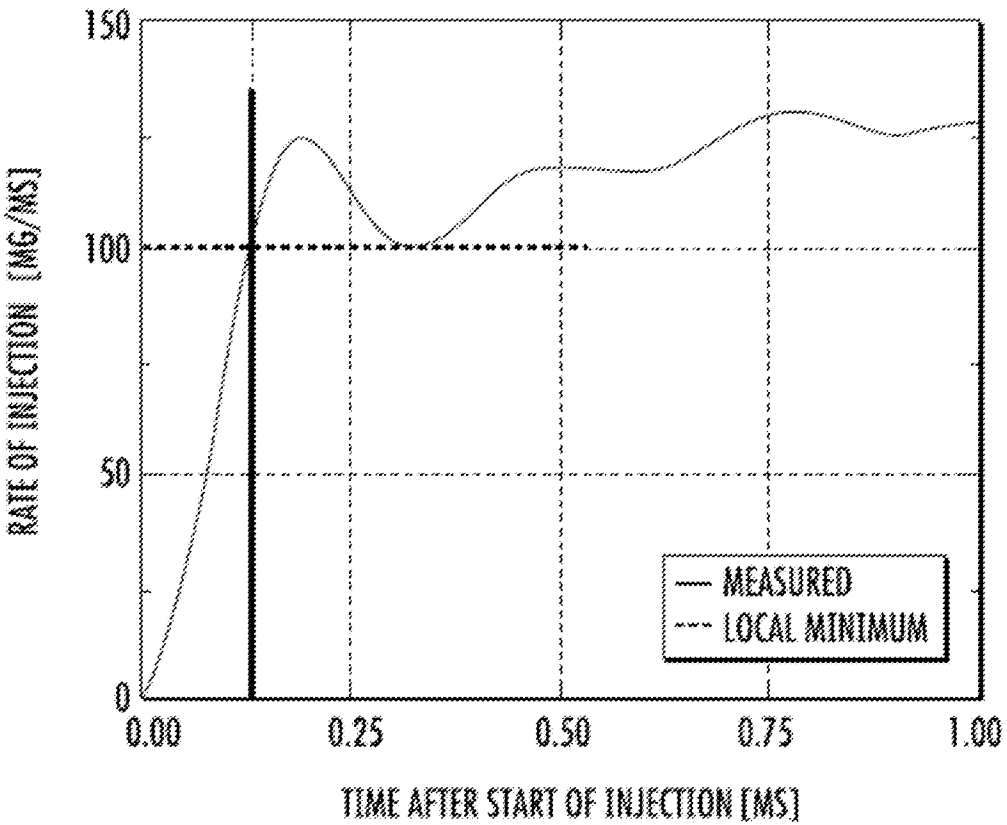
FIG. 16 is a graph that shows example ramp-up and top-flow region separation, in accordance with aspects of the present disclosure.

As the empirical model operates on this component region separation, the first act when building/generating the empirical model for each measured curve is to determine the points in time that separate the regions. The ramp-up and top flow regions were separated by calculating the point when the injection rate was equal to the local minimum of the first pulsation. An example using the 1948 bar data is shown in FIG. 16. In this example, the separation point is 0.13 ms after the start of injection. This separation point will be referred to herein as the top flow start time ($t_{tfs}$).

Figure 17:
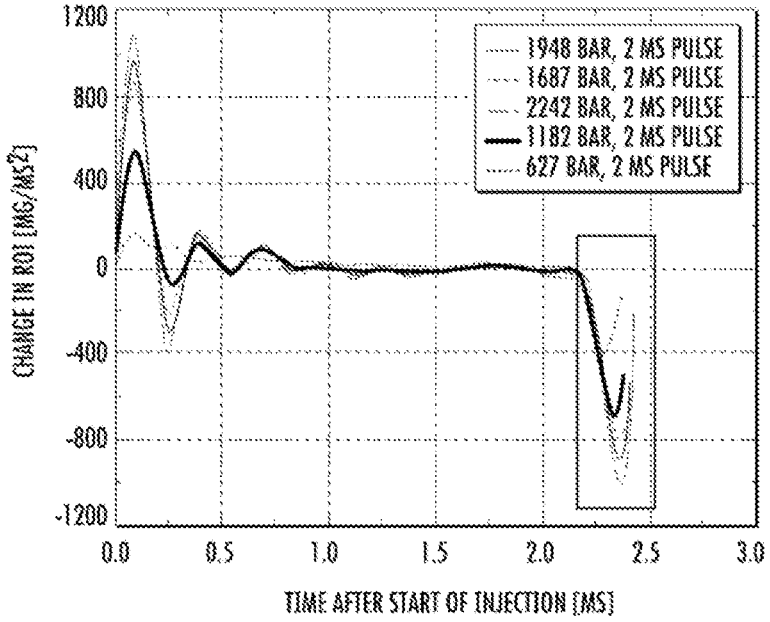
FIG. 17 is a graph that shows changes in ROI for measured data when operating at a 2.4 ms pulse duration.
Figure 18:
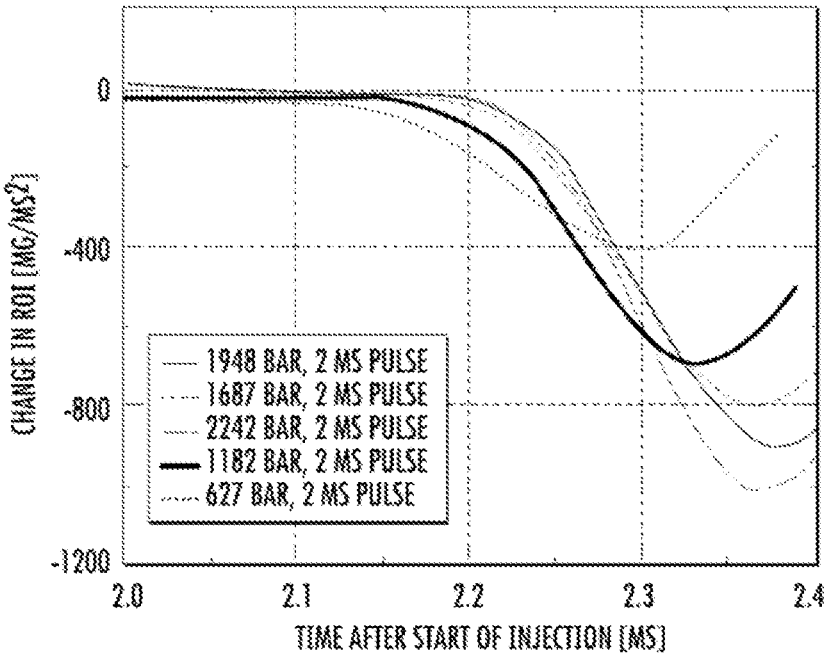
FIG. 18 is an enlarged view of the highlighted region in FIG. 17.

The top flow and ramp-down sections were separated by finding the point at which the rate of change was equal to or lower than −100 mg/ms$^2$ after 2 ms from the start of injection. FIGS. 17 and 18 show an example of these separation points.

The top flow to ramp down separation point for 1182 bar rail pressure was determined to be 2.20 ms from the start of injection. This separation point will be referred to as the top flow end time ($t_{tfe}$).

The angular velocity of the decaying sine wave function (ω) was determined by calculating the Period (T) between the local maxima of the first pulsation and using the angular velocity and Period relationship (Equation 6). After several angular velocity calculations for various pressures, this variable's variance was minimal, so the average calculated angular velocity of 20.94 rad/ms was used for the model. Considering the curves in FIG. 9A, this determination was validated as it is apparent in the respective graphs of FIG. 9A that the pulsation that occurs is independent of rail pressure and pulse duration. Instead, pulsation is characterized by other factors such as the injector design and the injected fluid properties.

$$\omega=\frac{2\pi}{T} \qquad \text{Equation (6)}$$

Figure 19:
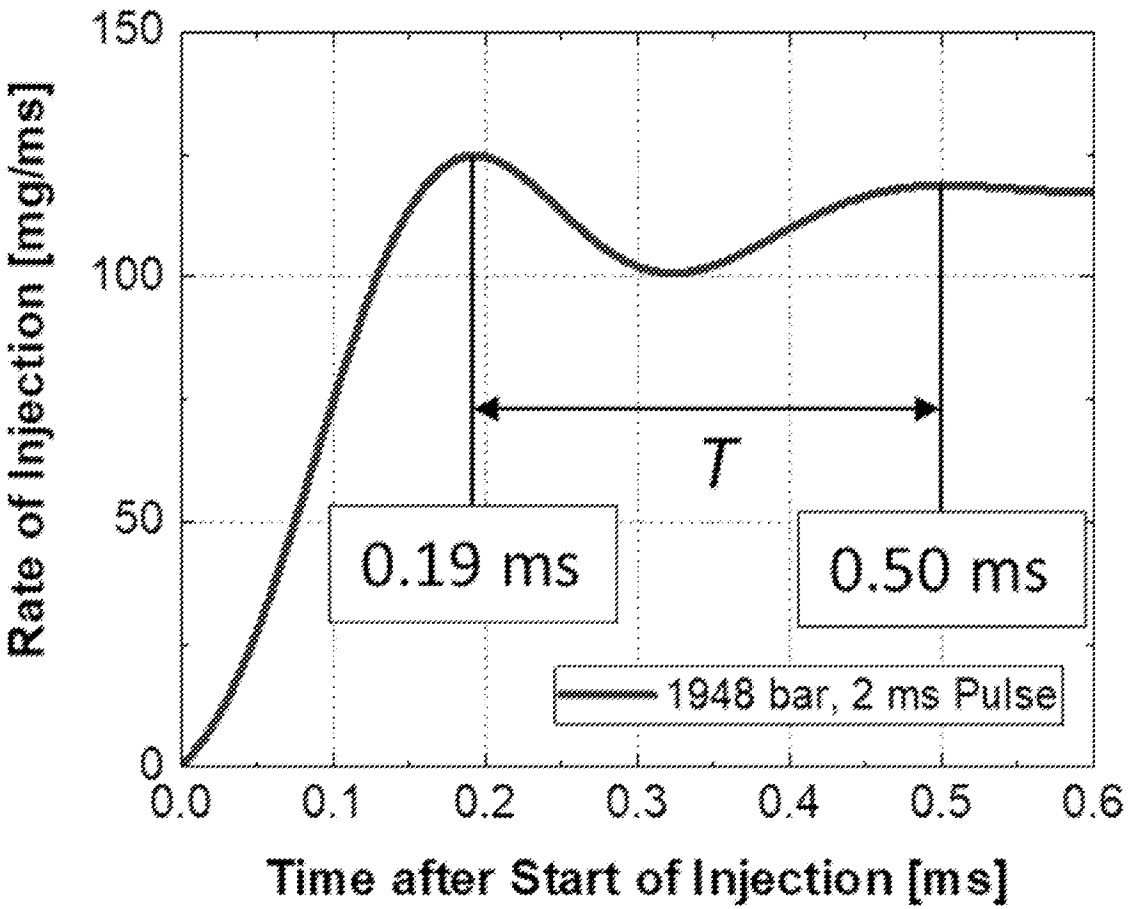
FIG. 19 is a graph that shows an example of ω and X derivation from measured data, in accordance with aspects of the present disclosure.

An example of the local maxima used to determine the period (and therefore the angular velocity of the decaying cosine wave) is shown in FIG. 19.

Figure 20:
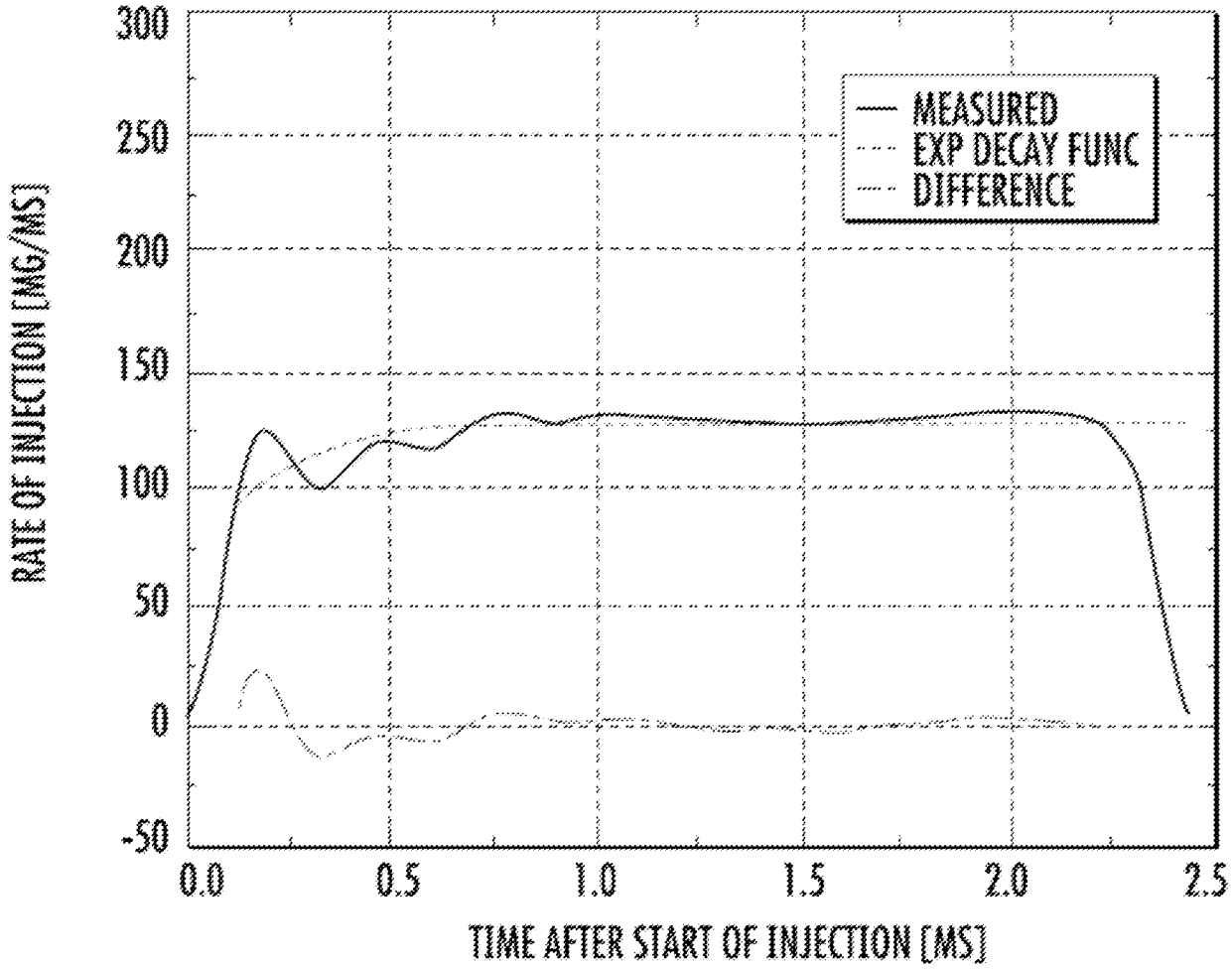
FIG. 20 shows the exponential decay function plotted against the measured data within the top-flow region, in accordance with aspects of the present disclosure.

FIG. 20 shows the exponential decay function plotted against the measured data within the top-flow region, along with the difference of the two (Difference=Measured−Exponential Decay).

The constant shift (c) of the exponential decay function was determined by taking the average of the measured ROI from t=1.25 ms to t=2.0 ms. This ensures that the model settles at the average ROI due to the nature of the decaying functions. An example of this can be seen in FIG. 19.

The time offset ($t_{pulse}$) for the dampened cosine wave function was determined by locating the point in time of the initial pulse peak. An example of this point in time is also shown in FIG. 20, wherein the time offset is 0.19 ms. The time offset did not deviate by more than 0.02 ms for the analyzed rail pressures, displaying the pulsating effect and was, therefore, determined to be independent of rail pressure.

The decay rate of the exponential decay function (r2) was determined by adjusting it to minimize the average of the residuals' squares between the exponential decay function and the measured data for each rail pressure within the top flow region.

The coefficient of the exponential decay function ($X_2$) was determined by taking the negative of the constant shift (c) and dividing the same in half for rail pressures where the initial rise followed by pulsation was observed. In the 627 bar case, the coefficient was not divided in half because the exponential decay curve must cross the y-axis at t=0; therefore, it should match the constant shift due to the top flow function's nature.

FIG. 20 thus shows how the exponential decay function tracks the trend of the measured data. However, when examining the "Difference" line, a sinusoid-like pulsating curve would be lost if the exponential decay function were used alone. This sinusoid-like curve is quickly dampened and becomes essentially linear approximately halfway through the injection. Due to the sinusoid-like difference curve starting near zero, a cosine function was chosen for modeling, dampened by multiplying this cosine function by a second exponential decay function, as shown in Table 3 (FIG. 14). The coefficient of the decaying cosine wave function, e.g., (X) in Equation 5, was determined by calculating the local maximum of the first peak in the difference curve. The dampening of the decaying cosine wave function (r) was determined by forcing the first local minimum of the decaying cosine wave function to match that of the difference curve.

The initial slope behavior did not appear in the 600 bar commanded pressure ROI. Therefore, the magnitude of the initial slope and fall slope was calculated from the ramp-down section.

Figure 21:
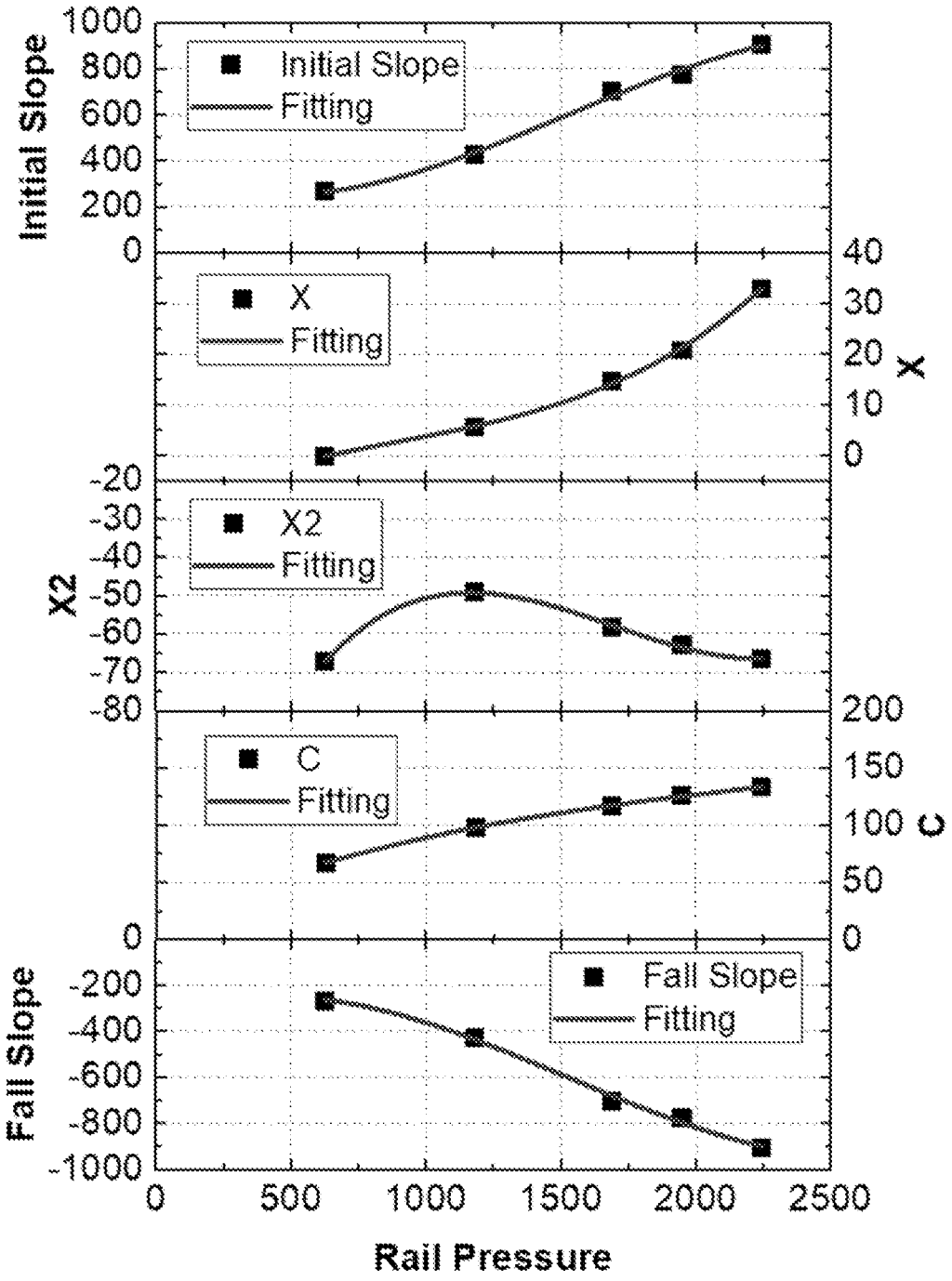
FIG. 21 shows polynomial fit curves for the determined variables (empirical modal constants) as a function of the rail pressure.

FIG. 21 shows polynomial fit curves for the determined variables as a function of the rail pressure. As was expected, the intensity of the initial pulse and the top flow average generally increase for increasing rail pressure. Of note is that the C variable will slowly approach a limit as the pressure is raised further. This points to a limitation in the top flow region of the ROI profile as the rail pressure is raised above the values measured in this example. Also, FIG. 21 shows a strong upward trend as rail pressure increases. This trend could be exploited for very high-pressure, short pulse durations. The trend shown combined with conclusions drawn from the 0.33-0.55 ms pulse durations in FIG. 9A can predict high mass accumulation for short injections at relatively high pressures. The results thus demonstrate the advantages of precise injector pulse duration when operating at relatively high rail pressures.

Figure 22:
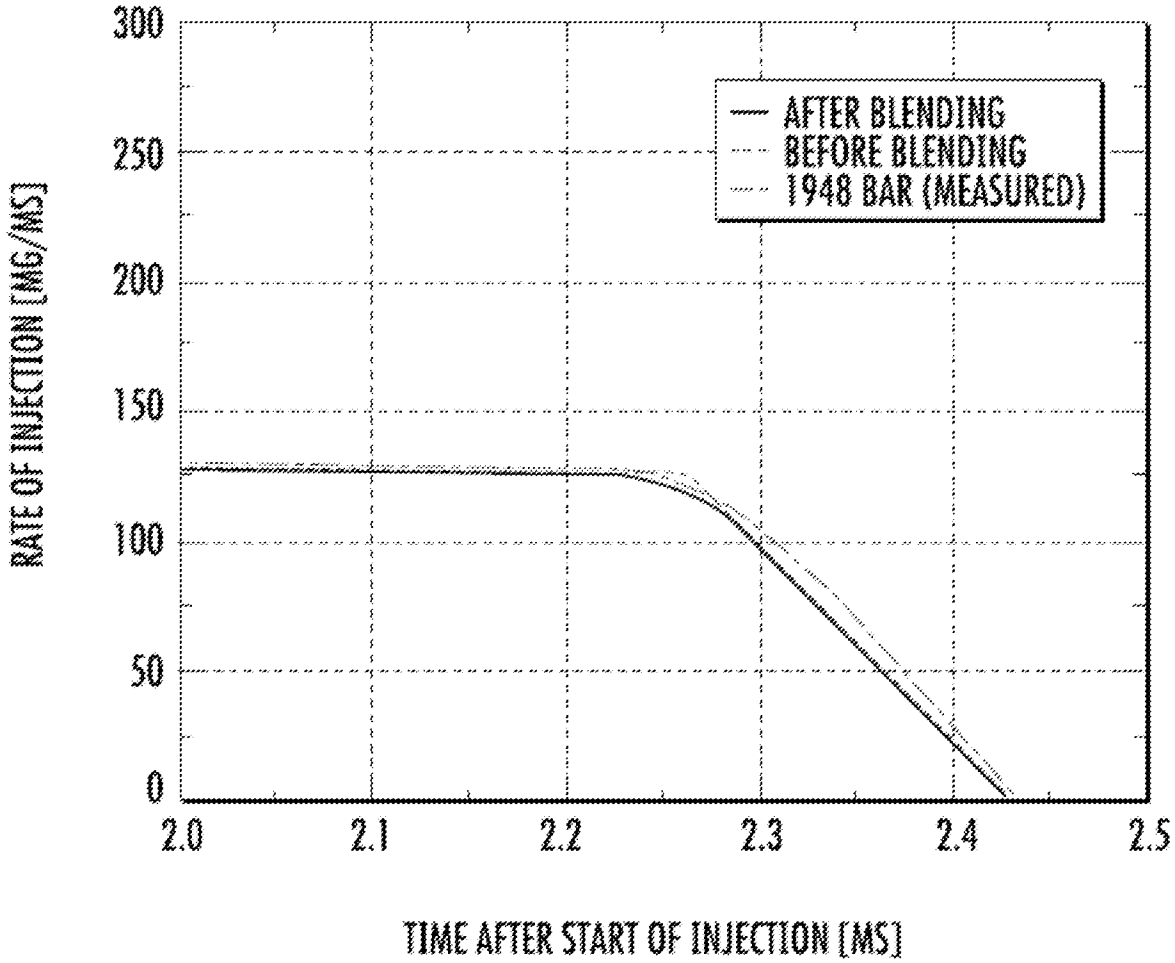
FIG. 22 is a graph that shows an example of top-flow and ramp-down transition before and after a blending process consistent with aspects of the present disclosure.

Finally, the empirical modeling method was used to "blend" the functions together. The "model blending" aims to change the slope around the top-flow to ramp-down separation point to gradually change over a relatively small time interval (e.g., 0.05 to 0.1 ms) rather than instantly changing. An example of a top-flow to ramp-down transition before and after blending can be seen in FIG. 22. This blending was observed to have a minimal/negligible effect on the accumulation but more accurately reflects how the profile transitions from top-flow to ramp-down for illustration purposes.

Figure 23:
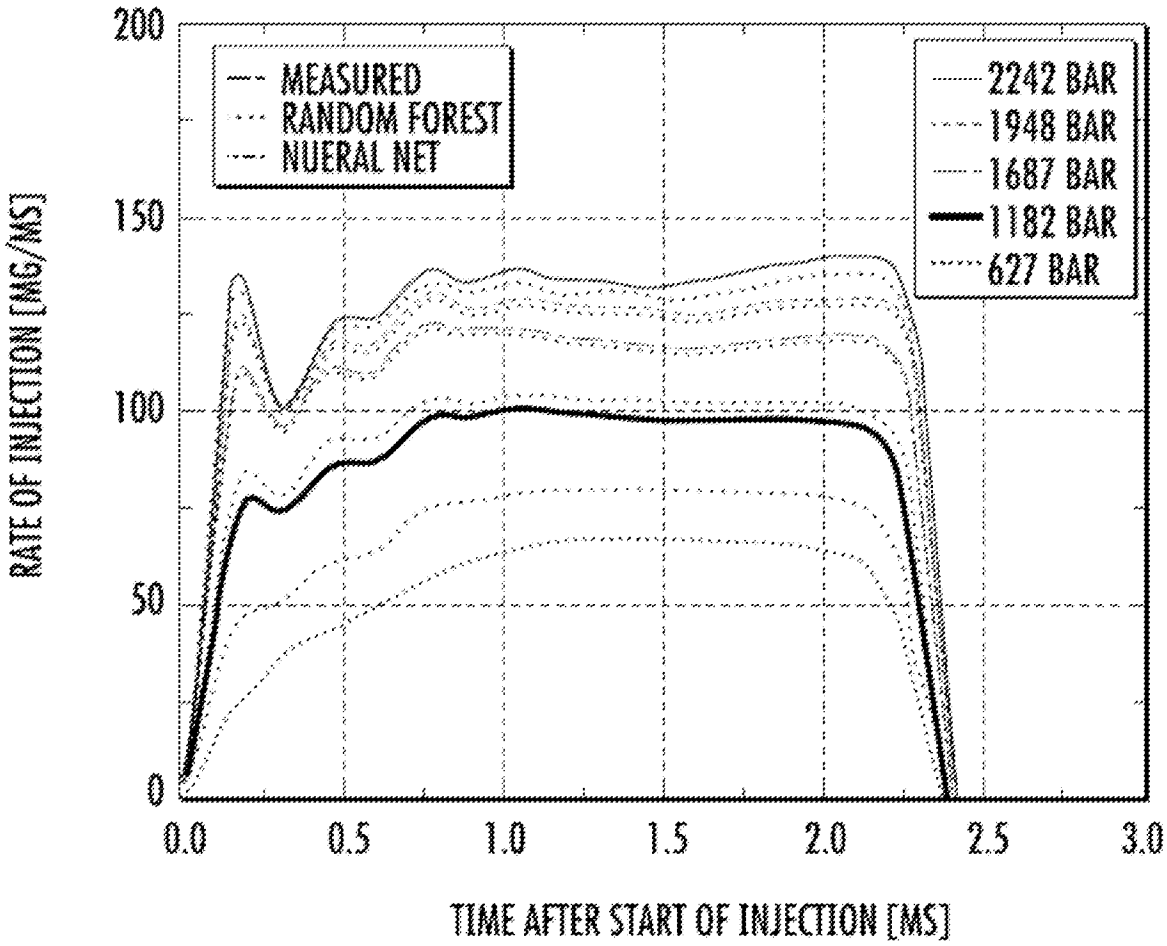
FIG. 23 is a graph that compares ROI profiles predicted/generated in accordance with aspects of the present disclosure relative to measured ROI profiles.

FIG. 23 is a graph that compares ROI profiles predicted in accordance with aspects of the present disclosure relative to measured ROI profiles. As shown, a random forest machine learning approach was utilized as well as a neural net (implemented as a MLP). As shown, the neural net produced near-identical results to the measured ROI profiles.

Figure 24:
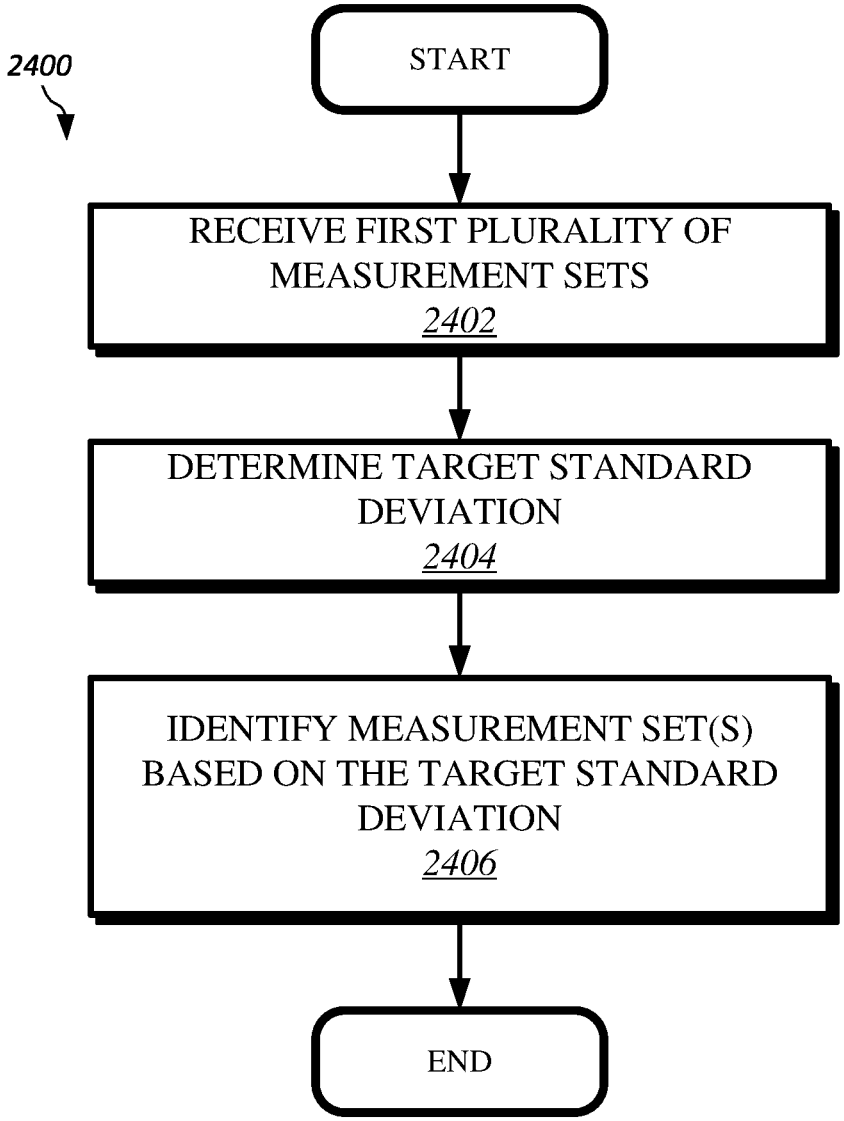
FIG. 24 shows a method that exemplifies various aspects of the present disclosure.

FIG. 24 shows a method 2400 that exemplifies various aspects of the present disclosure. The method 2400 includes receiving 2402 a first plurality of measurement sets, determining 2404 a target standard deviation, and identifying 2406 measurement set(s) based on the target standard deviation.

Figure 25:
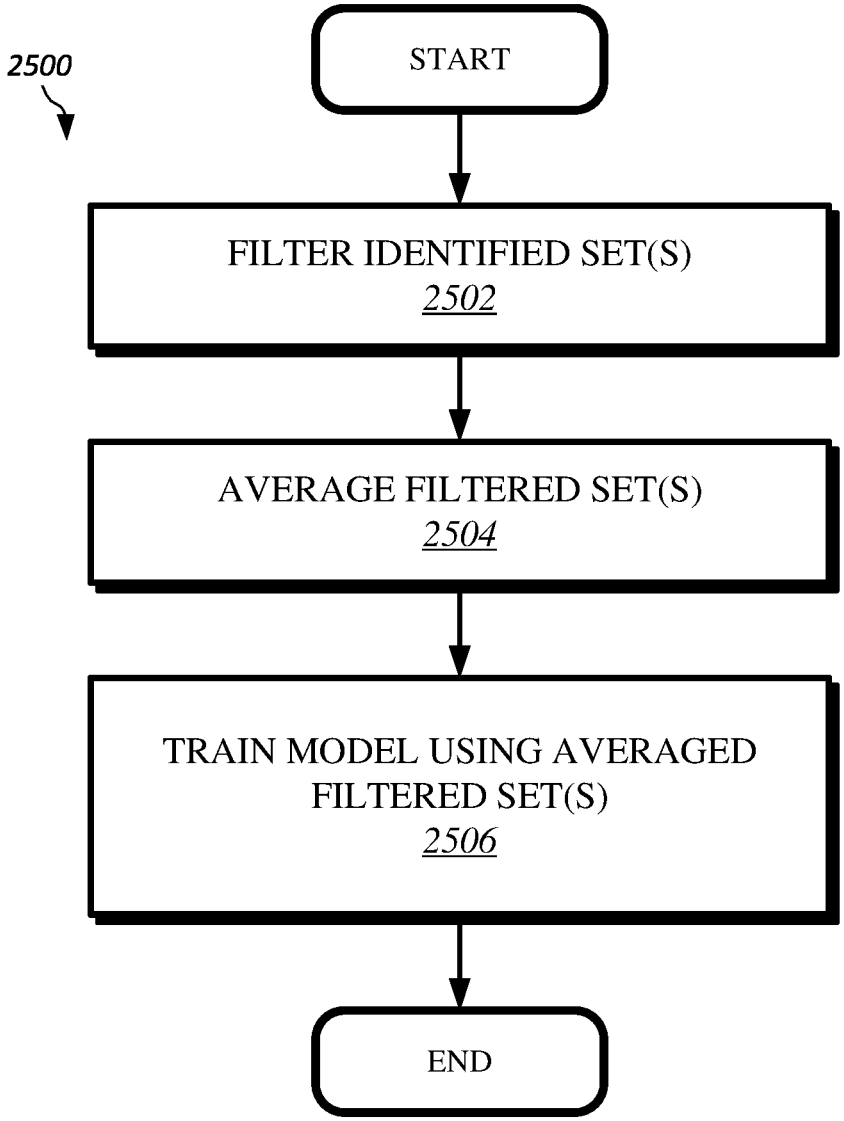
FIG. 25 shows another method that exemplifies various aspects of the present disclosure.

FIG. 25 shows another method 2500 that exemplifies various aspects of the present disclosure. The method 2500 includes filtering 2502 the identified measurement set(s) (e.g., from act 2406 of method 2400), averaging 2504 the filtered set(s), and training 2506 a model using the averaged filtered set(s). The filtering can include using a low-pass filter as discussed above. The model is preferably a MLP neural net. More preferably, the model is a MLP neural net that is trained with a predetermined number of iterations to induce overfitting during training as disclosed herein.

Figure 26:
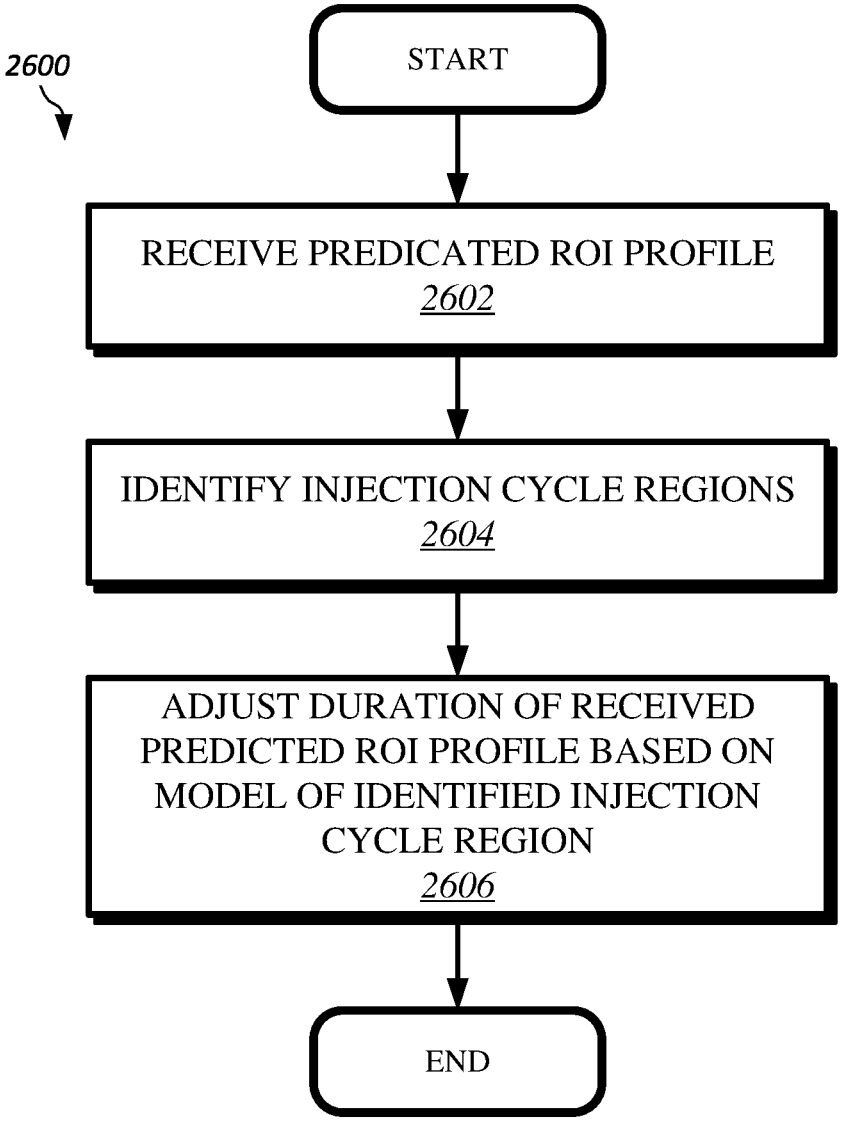
FIG. 26 shows another method that exemplifies various aspects of the present disclosure.

FIG. 26 shows another method 2600 that exemplifies various aspects of the present disclosure. The method 2600 includes receiving a predicted ROI profile 2602, identifying 2604 injection cycle regions (e.g., ramp-up, top-flow, and ramp-down), and adjusting 2606 the duration of the received predicted ROI profile based on a model of the identified injection cycle regions. Adjusting can include increasing or decreasing the duration of the ROI profile based on a desired overall duration target.

In accordance with an aspect of the present disclosure a method for determining a rate-of-injection (ROI) profile for a fuel injector is disclosed. The method comprising receiving, by a controller, a first plurality of measurement sets for the fuel injector, each measurement set of the first plurality of measurement sets corresponding to an injection cycle during which the fuel injector was fluidly coupled to a fuel rail and driven for a first predetermined duration to output fuel while the fuel rail was set to a first predetermined pressure, identifying, by the controller, at least two measurement sets of the first plurality of measurement sets with a first target standard deviation, generating, by the controller, a rate-of-injection (ROI) model for the fuel injector based on the at least two identified measurement sets, receiving, by the controller, a first target pressure value for the fuel rail and a target operational set point for the fuel injector, and generating, by the controller, a predicted ROI profile for the fuel injector by providing the first target pressure value and the target operational set point as an input into the ROI model.

In accordance with another aspect of the present disclosure a system for generating an rate-of-injection (ROI) profile for a fuel injector using a machine learning model is disclosed. The system comprising a controller configured to receive a first plurality of measurement sets for the fuel injector, each measurement set of the first plurality of measurement sets corresponding to an injection cycle during which the fuel injector was fluidly coupled to a fuel rail and driven for a first predetermined duration to output fuel while the fuel rail was set to a first predetermined pressure, identify at least two measurement sets of the first plurality of measurement sets with a first target standard deviation, generate a rate-of-injection (ROI) model for the fuel injector based on the at least two identified measurement sets, receive a first target pressure value for the fuel rail and a target operational set point for the fuel injector, and generate a predicted ROI profile for the fuel injector by providing the first target pressure value and the target operational set point into the ROI model.

In accordance with another aspect of the present disclosure, a non-transitory computer-readable medium storing instructions that when executed by a controller of a computer device cause the controller to perform a method for determining a rate-of-injection (ROI) profile for a fuel injector is disclosed. The method comprising receiving, by the controller, a first plurality of measurement sets for the fuel injector, each measurement set of the first plurality of measurement sets corresponding to an injection cycle during which the fuel injector was fluidly coupled to a fuel rail and driven for a first predetermined duration to output fuel while the fuel rail was set to a first predetermined pressure, identifying, by the controller, at least two measurement sets of the first plurality of measurement sets with a first target standard deviation, instantiating, by the controller, a neural network in a memory based on the at least two identified measurement sets, the neural network having an input layer, a hidden layer, and an output layer, the hidden layer having a plurality of neurons and connections therebetween, performing, by the controller, a predetermined number of training iterations to induce overfitting of the neural network such that an overall convergence error for output of the neural network is equal to or less than 0.0001, receiving, by the controller, a first target pressure value for the fuel rail and a target operational set point for the fuel injector, and generating, by the controller, a predicted ROI profile for the fuel injector by providing the first target pressure value and the target operational set point into the neural network.

Elements, components, modules, and/or parts thereof that are described and/or otherwise portrayed through the figures to communicate with, be associated with, and/or be based on, something else, may be understood to so communicate, be associated with, and/or be based on in a direct and/or indirect manner, unless otherwise stipulated herein.

Throughout the entirety of the present disclosure, use of the articles "a" and/or "an" and/or "the" to modify a noun may be understood to be used for convenience and to include one, or more than one, of the modified noun, unless otherwise specifically stated. The terms "comprising", "including" and "having" are intended to be inclusive and mean that there may be additional elements other than the listed elements. As used herein, use of the term "nominal" or "nominally" when referring to an amount means a designated or theoretical amount that may vary from the actual amount.

The foregoing description of example aspects has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future filed applications claiming priority to this application may claim the disclosed subject matter in a different manner, and may generally include any set of one or more limitations as variously disclosed or otherwise demonstrated herein.

What is claimed is:

1. A method for determining a rate-of-injection (ROI) profile for a fuel injector, the method comprising:

receiving, by a controller, a first plurality of measurement sets for the fuel injector, each measurement set of the first plurality of measurement sets corresponding to an injection cycle during which the fuel injector was fluidly coupled to a fuel rail and driven for a first predetermined duration to output fuel while the fuel rail was set to a first predetermined pressure;

identifying, by the controller, at least two measurement sets of the first plurality of measurement sets with a first target standard deviation;

generating, by the controller, a rate-of-injection (ROI) model for the fuel injector based on the at least two identified measurement sets;

receiving, by the controller, a first target pressure value for the fuel rail and a target operational set point for the fuel injector; and generating, by the controller, a predicted ROI profile for the fuel injector by providing the first target pressure value and the target operational set point as an input into the ROI model.

2. The method of claim 1, wherein generating the ROI model further comprises:

instantiating a neural network in a memory, the neural network having an input layer, a hidden layer, and an output layer, the hidden layer having a plurality of neurons and connections therebetween; and performing a predetermined number of training iterations to induce overfitting of the neural network such that an overall mean squared error for output of the neural network is equal to or less than 0.0001.

3. The method of claim 2, wherein the predetermined number of training iterations is in a range of 10^6 to 10^9.

4. The method of claim 2, wherein the hidden layer of the neural network has a total number of neurons in a range of 300 to 1000 neurons.

5. The method of claim 2, wherein the neural network is implemented a multilayer perceptron (MLP) neural network.

6. The method of claim 1, further comprising:

receiving, by a controller, a second plurality of measurement sets for the fuel injector, each measurement set of the second plurality of measurement sets corresponding to an injection cycle during which the fuel injector was fluidly coupled to a fuel rail and driven for a second predetermined duration to output fuel while the fuel rail was set to a second predetermined pressure, wherein the second predetermined duration is different from the first predetermined duration and/or the second predetermined pressure is different from the first predetermined pressure;

identifying, by the controller, at least two measurement sets of the second plurality of measurement sets with a second target standard deviation; and wherein generating the ROI model for the fuel injector is based on the at least two identified measurement sets of the first plurality of measurement sets and the at least two identified measurement sets of the second plurality of measurement sets.

7. The method of claim 1, wherein the target operational set point is a desired mass flow rate or a pulse duration for each injection cycle of the fuel injector.

8. The method of claim 1, wherein each measurement set of the first plurality of measurement sets include a plurality of measured pressure values for the fuel rail taken over the first predetermined duration of the injection cycle at a predetermined sampling rate.

9. The method of claim 8, wherein the predetermined sampling rate is in a range of 5 kilohertz (kHz) to 20 kHz.

10. The method of claim 1, further comprising applying a low-pass filter to a plurality of measured values represented within the at least two identified measurement sets of the first plurality of measurement sets to produce de-noised measurement values, and wherein generating the ROI model for the fuel injector is based on the de-noised measurement values.

11. The method of claim 1, further comprising:

identifying an overall standard deviation for the first plurality of measurement sets;

identifying a plurality of measurement sets within the first plurality of measurement sets having a lowest standard deviation relative to each other, the lowest standard deviation being less than the overall standard deviation; and wherein the first target standard deviation is equal to the lowest standard deviation.

12. The method of claim 1, further comprising outputting, by the controller, the predicted ROI profile to an engine control unit (ECU) to cause the ECU to adjust an operational characteristic of an engine.

13. The method of claim 12, wherein the ECU is instantiated within an engine simulation that models engine performance based on predetermined operating conditions.

14. The method of claim 13, wherein the operational characteristic is at least one of a engine efficiency, aftertreatment temperature, and/or soot emissions target.

15. A system for generating a rate-of-injection (ROI) profile for a fuel injector using a machine learning model, the system comprising:

a controller configured to:

receive a first plurality of measurement sets for the fuel injector, each measurement set of the first plurality of measurement sets corresponding to an injection cycle during which the fuel injector was fluidly coupled to a fuel rail and driven for a first predetermined duration to output fuel while the fuel rail was set to a first predetermined pressure;

identify at least two measurement sets of the first plurality of measurement sets with a first target standard deviation;

generate a rate-of-injection (ROI) model for the fuel injector based on the at least two identified measurement sets;

receive a first target pressure value for the fuel rail and a target operational set point for the fuel injector; and generate a predicted ROI profile for the fuel injector by providing the first target pressure value and the target operational set point into the ROI model.

16. The system of claim 15, wherein the controller is further configured to:

generate the ROI model by instantiating a neural network in a memory, the neural network having an input layer, a hidden layer, and an output layer, the hidden layer having a plurality of neurons and connections therebetween; and perform a predetermined number of training iterations to induce overfitting of the neural network such that an overall mean squared error for output of the neural network is equal to or less than 0.0001.

17. The system of claim 16, wherein the predetermined number of training iterations is in a range of 10^6 to 10^9.

18. The system of claim 16, wherein the hidden layer of the neural network has total number of neurons in a range of 300 to 1000 neurons.

19. The system of claim 16, wherein the neural network is implemented a multilayer perceptron (MLP) neural network.

20. The system of claim 15, wherein the controller is further configured to:

receive a second plurality of measurement sets for the fuel injector, each measurement set of the second plurality of measurement sets corresponding to an injection cycle during which the fuel injector was fluidly coupled to a fuel rail and driven for a second predetermined duration to output fuel while the fuel rail was set to a second predetermined pressure, wherein the second predetermined duration is different from the first predetermined duration and/or the second predetermined pressure is different from the first predetermined pressure;

identify at least two measurement sets of the second plurality of measurement sets with a second target standard deviation; and wherein the controller is further configured to generate the ROI model for the fuel injector based on the at least two identified measurement sets of the first plurality of measurement sets and the at least two identified measurement sets of the second plurality of measurement sets.

21. The system of claim 15, wherein the target operational set point is a desired mass flow rate or a pulse duration for each injection cycle of the fuel injector.

22. The system of claim 15, wherein each measurement set of the first plurality of measurement sets include a plurality of measured pressure values for the fuel rail taken over the first predetermined duration of the injection cycle at a predetermined sampling rate.

23. The system of claim 22, wherein the predetermined sampling rate is in a range of 5 kilohertz (kHz) to 20 kHz.

24. The system of claim 15, wherein the controller is further configured to apply a low-pass filter to a plurality of measured values represented within the at least two identified measurement sets of the first plurality of measurement sets to produce de-noised measurement values, and wherein the controller is further configured to generate the ROI model for the fuel injector based on the de-noised measurement values.

25. The system of claim 15, wherein the controller is further configured to:

identify an overall standard deviation for the first plurality of measurement sets;

identify a plurality of measurement sets within the first plurality of measurement sets having a lowest standard deviation relative to each other, the lowest standard deviation being less than the overall standard deviation; and wherein the first target standard deviation is equal to the lowest standard deviation.

26. The system of claim 15, wherein the controller is an engine control unit (ECU), and wherein the ECU is configured to adjust an operational characteristic of an engine based on the predicted ROI profile, wherein the operational characteristic is at least one of an engine efficiency target, a target aftertreatment temperature, and/or a soot emissions target.

27. A non-transitory computer-readable medium storing instructions that when executed by a controller of a computer device cause the controller to perform a method for determining a rate-of-injection (ROI) profile for a fuel injector, the method comprising:

receiving, by the controller, a first plurality of measurement sets for the fuel injector, each measurement set of the first plurality of measurement sets corresponding to an injection cycle during which the fuel injector was fluidly coupled to a fuel rail and driven for a first predetermined duration to output fuel while the fuel rail was set to a first predetermined pressure;

identifying, by the controller, at least two measurement sets of the first plurality of measurement sets with a first target standard deviation;

instantiating, by the controller, a neural network in a memory based on the at least two identified measurement sets, the neural network having an input layer, a hidden layer, and an output layer, the hidden layer having a plurality of neurons and connections therebetween;

performing, by the controller, a predetermined number of training iterations to induce overfitting of the neural network such that an overall convergence error for output of the neural network is equal to or less than 0.0001;

receiving, by the controller, a first target pressure value for the fuel rail and a target operational set point for the fuel injector; and generating, by the controller, a predicted ROI profile for the fuel injector by providing the first target pressure value and the target operational set point into the neural network.

28. The non-transitory computer-readable medium of claim 27, wherein instantiating the neural network further comprises instantiating the neural network as a multilayer perceptron (MLP) neural network.

29. The non-transitory computer-readable medium of claim 27, wherein the predetermined number of training iterations to induce overfitting is in a range of 10^6 to 10^9.

* * * * *